US007995947B2

(12) United States Patent
Yoshino et al.

(10) Patent No.: US 7,995,947 B2
(45) Date of Patent: Aug. 9, 2011

(54) IMAGE FORMING APPARATUS, AND CHARGING DEVICE AND PROCESS CARTRIDGE USED IN THE IMAGE FORMING APPARATUS

(75) Inventors: Kaoru Yoshino, Tokyo (JP); Takaya Muraishi, Kanagawa (JP); Akio Kosuge, Kanagawa (JP); Takeshi Shintani, Kanagawa (JP); Yasushi Akiba, Kanagawa (JP); Satoshi Hatori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 437 days.

(21) Appl. No.: 12/193,305

(22) Filed: Aug. 18, 2008

(65) Prior Publication Data

US 2009/0052939 A1 Feb. 26, 2009

(30) Foreign Application Priority Data

Aug. 22, 2007 (JP) ..... 2007-216383

(51) Int. Cl.
*G03G 15/02* (2006.01)
*G03G 21/18* (2006.01)

(52) U.S. Cl. ..... 399/100; 399/115

(58) Field of Classification Search ..... 399/100, 399/111, 115, 168, 170; 250/325
See application file for complete search history.

(56) References Cited

U.S. PATENT DOCUMENTS 3,978,379 A * 8/1976 DelVecchio ..... 399/170
5,797,071 A * 8/1998 Ozawa et al. ..... 399/159
6,064,845 A * 5/2000 Suzuki ..... 399/170
6,163,664 A * 12/2000 Hayashi ..... 399/100
6,819,893 B2 11/2004 Kikuchi
2007/0059063 A1* 3/2007 Nakayama et al. ..... 399/329
2010/0104317 A1* 4/2010 Tanase ..... 399/100

FOREIGN PATENT DOCUMENTS

JP 8-95349 4/1996
JP 10-301368 11/1998
JP 2003-50496 2/2003
JP 2004-317702 11/2004
JP 3619057 11/2004

* cited by examiner

*Primary Examiner* — David P Porta
*Assistant Examiner* — Faye Boosalis
(74) *Attorney, Agent, or Firm* — Oblon, Spivak, McClelland, Maier & Neustadt, L.L.P.

(57) ABSTRACT

The invention provides a charging device used in an image forming apparatus such as a copier, a fax machine, a printer or the like, the charging device including: a gold-plated discharge wire for charging an image carrier such as a photoconductive member or the like; and a cleaning member, having an abrasive, for cleaning the discharge wire, with the gold plating being maintained over time satisfactorily, and provides a process cartridge having this charging device. The cleaning member has an abrasive containing alumina and/or silicon, the grain size of which ranges from #6000 to #8000. The discharge wire is a tungsten wire on which a plating film is formed by gold plating, such that the thickness of the plating film is not smaller than 1.5 μm, and the diameter of the tungsten wire is not smaller than 30 μm.

20 Claims, 18 Drawing Sheets

FIG. 22A

WIRE DIAMETER : 40 [μm] CLEANING INTERVAL : EVERY 10,000 SHEET RUNS

| SHEET RUNNING TEST | GOLD PLATING FILM THICKNESS [μm] | PARTICLE DIAMETER AT 50% CUMULATIVE HEIGHT [μm] | HALFTONE NONUNIFORM DENSITY, RANK AFTER A4T SHEET RUNS | | |
|---|---|---|---|---|---|
| | | | 50,000 SHEETS | 100,000 SHEETS | 200,000 SHEETS |
| 1 | 1.0 | 3.0 (#4000) | 2 | — | — |
| 2 | 1.0 | 2.0 (#6000) | 4 | 2 | — |
| 3 | 1.0 | 1.2 (#8000) | 4 | 4 | 3 |
| 4 | 1.0 | 0.5 | 3 | — | — |
| 5 | 1.5 | 3.0 (#4000) | 3 | — | — |
| 6 | 1.5 | 2.0 (#6000) | 5 | 5 | 4 |
| 7 | 1.5 | 1.2 (#8000) | 5 | 5 | 4 |
| 8 | 1.5 | 0.5 | 3 | — | — |
| 9 | 3.0 | 3.0 (#4000) | 5 | 4 | 3 |
| 10 | 3.0 | 2.0 (#6000) | 5 | 5 | 4 |
| 11 | 3.0 | 1.2 (#8000) | 5 | 5 | 5 |
| 12 | 3.0 | 0.5 | 3 | — | — |

FIG. 22B

WIRE DIAMETER : 60 [μm] CLEANING INTERVAL : EVERY 10,000 SHEET RUNS

| SHEET RUNNING TEST | GOLD PLATING FILM THICKNESS [μm] | PARTICLE DIAMETER AT 50% CUMULATIVE HEIGHT [μm] | HALFTONE NONUNIFORM DENSITY, RANK AFTER A4T SHEET RUNS | | |
|---|---|---|---|---|---|
| | | | 50,000 SHEETS | 100,000 SHEETS | 200,000 SHEETS |
| 1 | 1.0 | 3.0 (#4000) | 3 | — | — |
| 2 | 1.0 | 2.0 (#6000) | 4 | 3 | — |
| 3 | 1.0 | 1.2 (#8000) | 4 | 4 | 3 |
| 4 | 1.0 | 0.5 | 2 | — | — |
| 5 | 1.5 | 3.0 (#4000) | 4 | 3 | — |
| 6 | 1.5 | 2.0 (#6000) | 5 | 5 | 4 |
| 7 | 1.5 | 1.2 (#8000) | 5 | 5 | 5 |
| 8 | 1.5 | 0.5 | 2 | — | — |
| 9 | 3.0 | 3.0 (#4000) | 5 | 4 | 3 |
| 10 | 3.0 | 2.0 (#6000) | 5 | 5 | 5 |
| 11 | 3.0 | 1.2 (#8000) | 5 | 5 | 5 |
| 12 | 3.0 | 0.5 | 2 | — | — |

$$SF2 = \frac{(PERI)^2}{AREA} \times \frac{1}{4\pi} \times 100$$

$$SF1 = \frac{(MXLNG)^2}{AREA} \times \frac{\pi}{4} \times 100$$

IMAGE FORMING APPARATUS, AND CHARGING DEVICE AND PROCESS CARTRIDGE USED IN THE IMAGE FORMING APPARATUS

BACKGROUND OF THE INVENTION

1. Field of the Invention

The present invention relates to an image forming apparatus such as a copier, a fax machine, a printer or the like. More particularly, the present invention relates to a charging device comprising a discharge wire for charging an image carrier such as a photoconductive member or the like, and a cleaning member for cleaning the discharge wire, and to a process cartridge comprising the charging device.

2. Description of the Related Art

Known such image forming apparatuses include image forming apparatuses comprising a charging device, for instance of scorotron type, having a discharge wire for charging an image carrier such as a photoconductive member or the like. With the passage of time, contamination accumulates on the discharge wire, impairing thereby the discharge performance of the discharge wire.

To prevent loss of discharge performance, these charging devices comprise a cleaning member for wiping clean the surface of the discharge wire, as described in, for instance, Japanese Patent Application Laid-open No. 2004-317702, Japanese Patent Application Laid-open No. H10-301368, Japanese Patent No. 3619057, Japanese Patent Application Laid-open No. H08-095349, and Japanese Patent Application Laid-open No. 2003-050496.

Known cleaning members include cleaning members comprising an abrasive for increasing the removability of contamination adhered to the surface of the discharge wire, for instance as disclosed in Japanese Patent Application Laid-open No. 2004-317702, Japanese Patent Application Laid-open No. H10-301368, Japanese Patent No. 3619057, and Japanese Patent Application Laid-open No. H08-095349. Other known cleaning members do not comprise an abrasive, for instance as disclosed in Japanese Patent Application Laid-open No. 2003-050496, on the grounds that the abrasive comprised in the cleaning member may whittle away the discharge wire.

A protective film such as an oxide film, gold plating or the like, may also be formed on the surface of the discharge wire, as disclosed in, for instance, Japanese Patent Application Laid-open No. H08-095349, and Japanese Patent Application Laid-open No. 2003-050496.

Protection of the discharge wire is high when using an oxide film, having high wear resistance, as the protective film, even when the cleaning member comprises an abrasive. However, contamination adheres readily onto oxide films, and hence the discharge wire must be cleaned frequently. Image formation cannot take place during wire cleaning, and hence highly frequent cleaning is problematic in that it adds to image forming apparatus downtime.

By contrast, using gold plating as the protective film is advantageous in that contamination adheres less readily to the protective film. However, the gold-plating protective film is readily damaged when the cleaning member comprises an abrasive, as described in Japanese Patent Application Laid-open No. 2003-050496.

In terms of downtime of the image forming apparatus, however, it is preferable to gold-plate the discharge wire, to hinder adhesion of contamination onto the surface of the discharge wire. At the same time, a cleaning member comprising an abrasive is also preferable, in terms of cleanability of the discharge wire. Moreover, the gold plating must also be preserved in good condition as time goes by.

SUMMARY OF THE INVENTION

It is thus an object of the present invention to provide a charging device used in an image forming apparatus such as a copier, a fax machine, a printer or the like, the charging device comprising a gold-plated discharge wire for charging an image carrier such as a photoconductive member or the like, and a cleaning member, having an abrasive, for cleaning the discharge wire.

A further object of the invention is to provide a process cartridge comprising the charging device.

In an aspect of the present invention, a charging device comprises a discharge wire for charging an image carrier; and a cleaning member for cleaning the discharge wire. The cleaning member has an abrasive containing alumina and/or silicon. A grain size of the abrasive ranges from #6000 to #8000. The discharge wire is a tungsten wire on which a plating film is formed by gold plating. A thickness of the plating film is not smaller than 1.5 μm, and a diameter of the tungsten wire is not smaller than 30 μm.

In another aspect of the present invention, an image forming apparatus has a charging device which comprises a discharge wire for charging an image carrier; and a cleaning member for cleaning the discharge wire. The cleaning member has an abrasive containing alumina and/or silicon. A grain size of the abrasive ranges from #6000 to #8000. The discharge wire is a tungsten wire on which a plating film is formed by gold plating. A thickness of the plating film is not smaller than 1.5 μm, and a diameter of the tungsten wire is not smaller than 30 μm.

In another aspect of the present invention, a process cartridge is detachably mounted on an image forming apparatus and integrally comprises at least one of a charging device, an image carrier that is charged by the charging device, a developing device for developing a latent image to be formed on a surface of the image carrier, and a cleaning device for cleaning the surface of the image carrier. The charging device comprises a discharge wire for charging an image carrier, and a cleaning member for cleaning the discharge wire. The cleaning member has an abrasive containing alumina and/or silicon. A grain size of the abrasive ranges from #6000 to #8000. The discharge wire is a tungsten wire on which a plating film is formed by gold plating. A thickness of the plating film is not smaller than 1.5 μm, and a diameter of the tungsten wire is not smaller than 30 μm.

BRIEF DESCRIPTION OF THE DRAWINGS

The above and other objects, features and advantages of the present invention will become more apparent from the following detailed description taken with the accompanying drawings in which:

FIGS. 22A and 22B are charts summarizing the results of ranking tests for assessing changes over time in a discharge wire, by modifying plating film thickness, abrasive grain size, and discharge wire diameter;

DESCRIPTION OF THE PREFERRED EMBODIMENT(s)

The present invention is explained in detail next based on examples.

Figure 1:
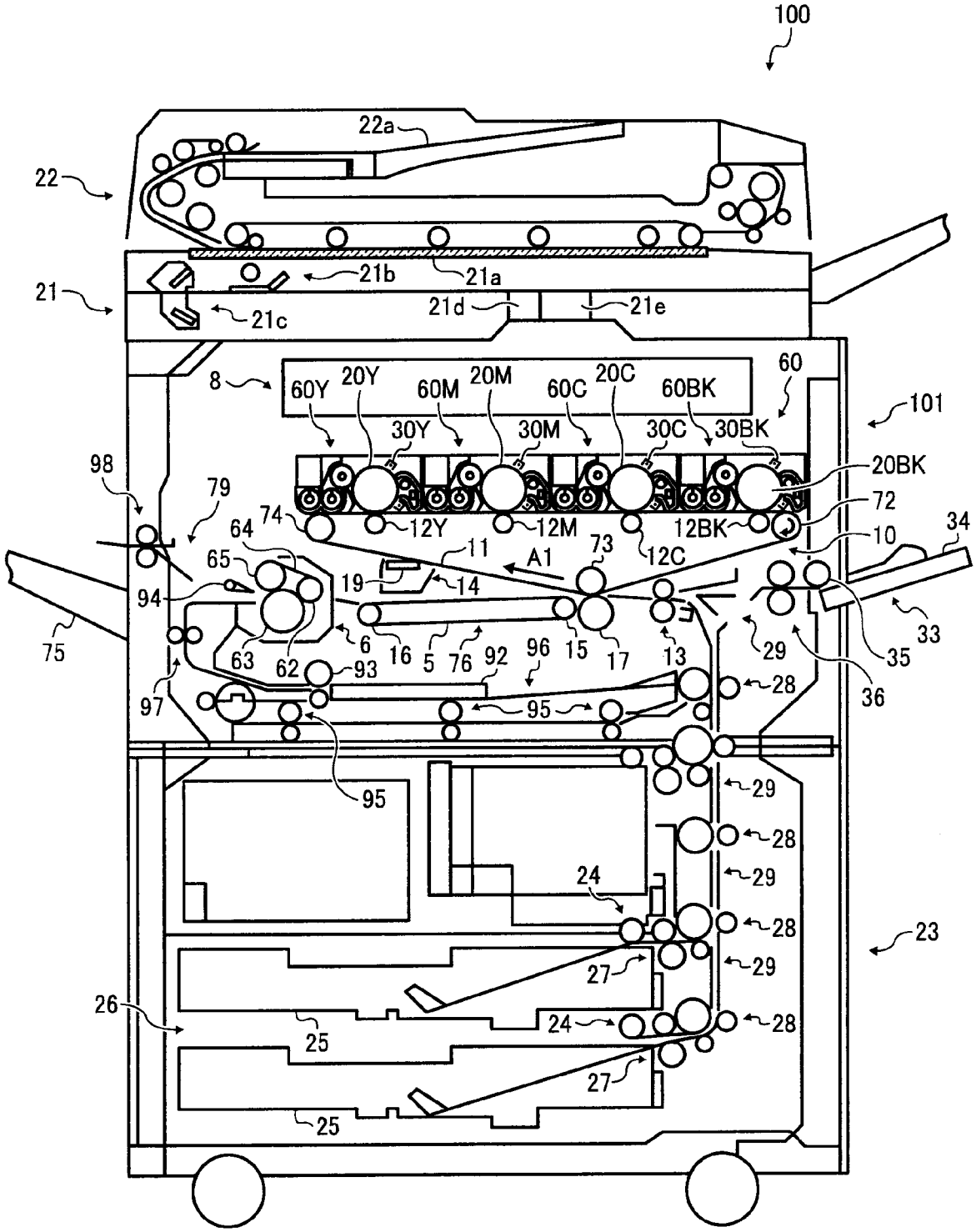
FIG. 1 is a front-view diagram illustrating the schematic constitution of an image forming apparatus using the present invention.

FIG. 1 illustrates the schematic constitution of an image forming apparatus using the present invention. The image forming apparatus 100 is a multifunction apparatus with copier, printer and fax machine, capable of forming full color images. When used as a printer and/or a fax machine, the image forming apparatus 100 performs image formation on the basis of image signals corresponding to image information received from outside.

The image forming apparatus 100 can form images on a sheet-like recording medium, namely recording paper such as ordinary paper used normally in copiers and so forth, as well as thick paper for OHP sheets, cards, postcards, envelopes or the like. The image forming apparatus 100 is also a double-sided image forming apparatus capable of forming images on both sides of a sheet as the recording medium.

The image forming apparatus 100 comprises a main body 101 occupying a central position in the up-and-down direction; a reading device 21, in the form of a scanner, positioned above the main body 101, for reading documents; an automatic document feeder (ADF) 22 on which the documents are loaded, such that the documents loaded on the automatic document feeder 22 are transported by the latter to a reading device 21; and a sheet feeding device 23, positioned under the main body 101, as a paper feeding table on which there are loaded sheets that are transported between photoconductive drums 20Y, 20M, 20C, 20BK and an intermediate transfer belt 11.

The image forming apparatus 100 is a tandem-type image forming apparatus using a tandem structure in which the photoconductive drums 20Y, 20M, 20C, 20BK, as a plurality of image carriers capable of forming images corresponding to respective separated colors (yellow, magenta, cyan and black), are disposed side by side. The photoconductive drums 20Y, 20M, 20C, 20BK, which have the same diameter, are equidistantly arranged, side by side, on the outer peripheral side, i.e. the image forming side, of the intermediate transfer belt 11 as an intermediate transfer element, which is an endless belt onto which images are transferred, the transfer belt 11 being disposed in substantially the central portion inside the main body 101 of the image forming apparatus 100.

The intermediate transfer belt 11 can move in the direction of the arrow A1, which is the clockwise direction in the figure, while facing the photoconductive drums 20Y, 20M, 20C, 20BK. The visible images, i.e. toner images, formed on the respective photoconductive drums 20Y, 20M, 20C, 20BK are supposedly transferred to the intermediate transfer belt 11 that moves in the direction of the arrow A1, and are then batch-transferred onto a sheet. The image forming apparatus 100 resorts thus to intermediate transfer, also known as indirect transfer.

In superposition transfer to the intermediate transfer belt 11, the following takes place as the intermediate transfer belt 11 moves in the A1 direction. The toner images formed on the respective photoconductive drums 20Y, 20M, 20C, 20BK are transferred, in such a manner so as to become superposed on a same position on the intermediate transfer belt 11, through application of voltage, by primary transfer rollers 12Y, 12M, 12C, 12BK as first transfer means in the form of transfer chargers disposed at positions facing respective photoconductive drums 20Y, 20M, 20C, 20BK, such that the intermediate transfer belt 11 is sandwiched between the photoconductive drums 20Y, 20M, 20C, 20BK and the primary transfer rollers 12Y, 12M, 12C, 12BK. The toner images are transferred, with staggered timings, from upstream to downstream in the A1 direction, at the transfer positions, namely the positions immediately below the respective photoconductive drums 20Y, 20M, 20C, 20BK.

The photoconductive drums 20Y, 20M, 20C, 20BK are disposed side by side, in this order, from the upstream side in the A1 direction. The photoconductive drums 20Y, 20M, 20C, 20BK are provided in respective image stations 60Y, 60M, 60C, 60BK for forming yellow, magenta, cyan and black images.

The image forming apparatus 100 comprises an image forming unit 60, as an image forming portion, comprising the four image stations 60Y, 60M, 60C, 60BK; a transfer belt unit 10, as an intermediate transfer unit, comprising the intermediate transfer belt 11, and provided below the photoconductive drums 20Y, 20M, 20C, 20BK, opposing the latter; a secondary transfer roller 17, which is a transfer member in the form of a secondary transfer device, as a second transfer means, being a transfer charger, for transferring, onto a sheet, the toner images formed on the intermediate transfer belt 11, the secondary transfer roller 17 being disposed opposite the intermediate transfer belt 11, abutting the latter, and rotating in the same direction as that of the intermediate transfer belt 11 at the abutting position with the intermediate transfer belt 11; a transport device 76 for transporting sheets having had transferred thereon the toner image on the intermediate transfer belt 11, by way of the secondary transfer roller 17; and an intermediate transfer belt cleaning device 14, disposed against the intermediate transfer belt 11, for cleaning the intermediate transfer belt 11 after the toner image disposed on the intermediate transfer belt 11 is transferred to the sheets.

The image forming apparatus 100 comprises also an optical scanning device 8, disposed above the image stations 60Y, 60M, 60C, 60BK, being an exposure device, in the form of a writing unit, as an optical writing device that is a writing means; a resist roller 13 for paying out sheets transported from the sheet feeding device 23 to the transfer portion between the intermediate transfer belt 11 and the secondary transfer roller 17, with a predetermined timing that is synchronized with the toner image formation timings in the image stations 60Y, 60M, 60C, 60BK; and a sensor, not shown, for detecting that the leading end of the sheet has reached the resist roller 13.

The image forming apparatus 100 comprises also a fixing device 6, as a fixing means, in the form of a belt fixing-type fixing unit for fixing toner images on the sheet when the latter, transported by the transport device 76, enters into the fixing device 6; a paper output unit 79 for transporting the sheet along either a paper output path, in which the fixed sheet is discharged out of the main body 101, and a reversing path along which the fixed sheet is transported again towards the resist roller 13; and a double-sided unit 96, being a sheet reversing device, as a paper re-feeding unit, for switching back a sheet when the paper output unit 79 conveys that sheet, having an image formed on one face thereof, towards the reversing path, and for transporting the sheet again towards the developing device 13.

The image forming apparatus 100 further comprises a paper output tray 75, disposed outside the main body 101, where the sheets become stacked after image formation; a manual paper feeding device 33 disposed on the right face of the main body 101, in FIG. 1; an operation panel, not shown, for operating the image forming apparatus 100; and control means, not shown, for controlling the operation of the entire image forming apparatus 100.

The transfer belt unit 10 comprises, besides the intermediate transfer belt 11, the primary transfer rollers 12Y, 12M, 12C, 12BK, a driving roller 72 on which the intermediate transfer belt 11 is wound, a transfer entry roller 73 as a secondary transfer opposing roller, and a tension roller 74, as a driven roller, and comprises the secondary transfer 17, the intermediate transfer belt cleaning device 14, and driving means, not shown, for swinging the transfer belt unit 10.

The transfer belt unit 10 is swung by the driving means in a counterclockwise direction around the driving roller 72 in FIG. 1, in such a manner so as to move the photoconductive drums 20Y, 20M, 20C away from the intermediate transfer belt 11 while keeping the photoconductive drum 20BK abutting against the intermediate transfer belt 11.

The configuration illustrated in FIG. 1 corresponds to formation of full color images. When forming single color images in black, the photoconductive drums 20Y, 20M, 20C are moved away from the intermediate transfer belt 11. The driving means are controlled by the control means.

The intermediate transfer belt cleaning device 14 has a rubber blade 19 abutting the intermediate transfer belt 11. The intermediate transfer belt cleaning device 14 cleans the intermediate transfer belt 11 by removing toner contamination and the like, through scraping, off the intermediate transfer belt 11, onto which materials such as toner, paper dust or the like become adhered.

The image forming apparatus 100 comprises the intermediate transfer belt cleaning device 14. Thus, black residual toner does not contaminate the photoconductive drums 20Y, 20M, 20C when transferred from the intermediate transfer belt 11 onto the photoconductive drums 20Y, 20M, 20C, during single-color image formation in black, and hence there is, in principle, no need to move the photoconductive drums 20Y, 20M, 20C away from the intermediate transfer belt 11 in that case. However, the photoconductive drums 20Y, 20M, 20C are moved away from the intermediate transfer belt 11, also when black single-color images are formed, in anticipation that, for some reason, the residual toner fails to be completely removed by the intermediate transfer belt cleaning device 14. That is because black toner is readily noticeable and can hence affect substantially the formed images, if adhered to the photoconductive drums 20Y, 20M, 20C.

For the same reason, the photoconductive drum 20BK, where black image formation takes place, is disposed more downstream in the A1 direction than the other photoconductive drums 20Y, 20M, 20C. That is because, during full color image formation, the intermediate transfer belt 11 is kept abutting the photoconductive drums 20Y, 20M, 20C, 20BK. Therefore, to prevent black toner from adhering to the photoconductive drums 20Y, 20M, 20C via the intermediate transfer belt 11, it is preferable to arrange the photoconductive drum 20BK at the most downstream position in the A1 direction, and to transfer the black toner to the intermediate transfer belt 11 last of all.

The transport device 76 comprises an endless-type transport belt 5 for transporting sheets, and a driving roller 15 and a driven roller 16 on which the toner belt 5 is wound.

The secondary transfer roller 17 opposes the transfer entrance roller 73, and presses against the intermediate transfer belt 11 that is disposed between the secondary transfer roller 17 and the transfer entrance roller 73. The secondary transfer roller 17 may also be comprised in a transfer and transport unit, in which a same member doubles as the secondary transfer roller 17 and the driven roller 16 of the transport device 76, for transporting sheets towards the fixing device 6.

The optical scanning device 8, for forming an electrostatic latent image, exposes, through scanning, a surface to be scanned that is made up of the surfaces of the photoconductive drums 20Y, 20M, 20C, 20BK. The optical scanning device 8 comprises a light source, not shown, for emitting laser light, not shown, as a laser beam, on the basis of image signals; a polygon mirror, not shown, which rotates for scanning the laser light emitted by the light source; a polygon motor, not shown, for rotationally driving the polygon mirror;

and multiple optical elements, not shown, for scanning the laser light scanned by the polygon mirror, onto the photoconductive drums 20Y, 20M, 20C, 20BK, and forming on the latter images of the scanned light. An LED may be used as the light source.

The fixing device 6 comprises a heating roller 62 having a built-in heat source; a fixing belt 64 wound on the heating roller 62; a fixing roller 65 around which, as is the case with the heating roller 62, the fixing belt 64 is wound, and a pressing roller 63 for pressing the fixing belt 64 between the fixing roller 65 and the pressing roller 63. When the sheet carrying the toner image passes through the fixing portion, which is the contact pressure portion between the fixing belt 64 and the pressing roller 63, the carried toner image becomes fixed on the surface of the sheet through the action of heat and pressure.

The paper output unit 79 comprises transport rollers 97 for transporting the fixed sheet, coming from the fixing device 6, towards the double-sided unit 96; paper outputs rollers 98 for discharging the sheet out of the main body 101; and a switching claw 94 for switching between guiding the fixed sheet onto the paper output path of the transport rollers 97, and thence out of the main body 101, or guiding the fixed sheet onto the reversing path of the paper output rollers 98, and thence into the double-sided unit 96.

The double-sided unit 96 comprises, for instance, a tray 92 on which there is loaded a sheet having an image formed on one side thereof, transported from the paper output unit 79; a reversing roller 93 for switching back the sheet on the tray 92, and paper feeding rollers 95 for feeding the sheet switched back by the reversing roller 93 towards the resist roller 13.

The sheet feeding device 23 comprises a paper bank 26 having a plurality of paper feeding cassettes 25 on which plural sheets are stacked; feeding rollers 24, as paper feeding rollers, abutting the top face of the uppermost sheet amongst the sheets stacked on the paper feeding cassettes 25; separating rollers 27 for separating, one by one, the sheets paid out by the feeding rollers 24; transport rollers 28 for transporting towards the resist roller 13 the sheets fed by the paper feeding rollers 24 and the separating rollers 27; and a paper feeding path 29 through which there pass the sheets transported by the transport rollers 28.

The paper feeding path 29 is provided so as to communicate the sheet feeding device 23 with the interior of the main body 101, such that further transport rollers 28 are also disposed in the paper feeding path 29 inside the main body 101.

In the sheet feeding device 23, the feeding rollers 24 are rotationally driven in the counterclockwise direction in the figure. Thereupon, the action of the separating rollers 27 causes the uppermost sheet to be guided into the paper feeding path 29, where it is fed towards the resist roller 13 through the rotation of the transport rollers 28. The sheet thus transported stops upon hitting against the resist roller 13.

The manual paper feeding device 33 comprises a manual tray 34 for loading sheets; a feeding roller 35, as a paper feeding roller, abutting the top face of the uppermost sheet loaded on the manual tray 34; separating rollers 36 for separating, one by one, the sheets paid out by the feeding roller 35; and a paper sensor for detecting that sheets are loaded on the manual tray 34.

In the manual paper feeding device 33, the feeding roller 35 is rotationally driven in the clockwise direction of the figure. Thereupon, the action of the separating rollers 36 causes the uppermost sheet to be guided into the paper feeding path 29 on the side of the main body 101, where it is fed towards the resist roller 13. The sheet thus transported stops upon hitting against the resist roller 13.

The reading device 21 comprises, for instance, a contact glass 21*a* on which a document is placed; a light source, not shown, for irradiating light onto the document placed on the contact glass 21*a*; a first reflective member, not shown, for reflecting the light emitted by the light source and reflected by the document; a first traveling body 21*b* traveling in the left-right direction of FIG. 1; a second traveling body 21*c* comprising a second reflective member, not shown, for reflecting light reflected by the reflective member of the first traveling body 21*b*; an image forming lens 21*d* for forming an image of the light from the second traveling body 21*c*; and a reading sensor 21*e* for receiving the light condensed via the image forming lens 21*d* and reading the content of the document by.

The automatic document feeder 22, which has a document stand 22*a* on which the document is set, can swivel relative to the reading device 21, such that the contact glass 21*a* becomes exposed when the automatic document feeder 22 is swung upwards. When the image forming apparatus 100 is used for making copies, the document is set on the document stand 22*a* of the automatic document feeder 22, or is placed manually on the contact glass 21*a*, after swinging up the automatic document feeder 22. Thereafter the automatic document feeder 22 is closed, to press thereby the document against the contact glass 21*a*.

The control panel comprises, for instance, a start button for initiating copying; a numerical keypad for inputting the number of copies and so forth; and a mode selection key for selecting an image formation mode among, for instance, multicolor image formation, or single-color image formation in black.

The control means comprises, for instance, a CPU and a storage means in the form of a memory.

The constitution of the image station 60Y comprised in the photoconductive drum 20Y, as one representative image station among the image stations 60Y, 60M, 60C, 60BK, is explained next. The constitution of the other image stations is substantially the same. For the sake of convenience, therefore, the reference numerals corresponding to the reference numerals in the image station comprising the photoconductive drum 20Y apply also to the constitution of the other image stations, and a recurrent detailed explanation thereof will be omitted. The letters Y, M, C, K suffixed to the various reference numerals denote elements for forming yellow, magenta, cyan and black, respectively.

Figure 2:
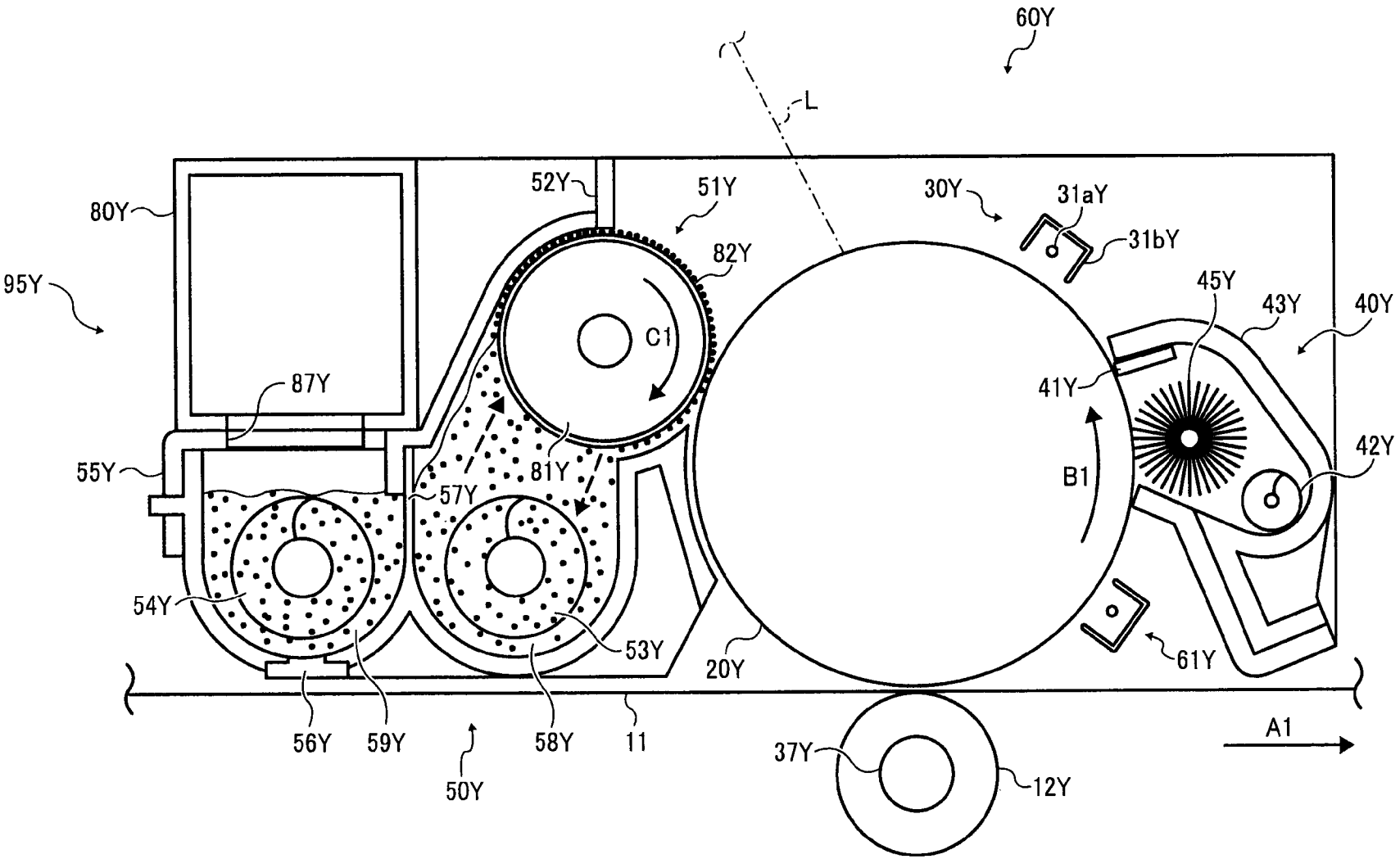
FIG. 2 is a front-view diagram illustrating the schematic constitution of one image carrier among a plurality of image carriers comprised in the image forming apparatus.

As illustrated in FIG. 2, the image station 60Y comprising the photoconductive drum 20Y has a primary transfer roller 12Y rotating in the rotation direction B1, counterclockwise in the figure, on the periphery of the photoconductive drum 20Y; a charge removing device 61Y as a charge removing means, in the form of a charge eliminator; a cleaning device 40Y as a cleaning means; a charging device 30Y as a charging unit, in the form of a charger that is a charging means; and a developing device 50Y as a developing means being a developing unit.

The photoconductive drum 20Y, the cleaning device 40Y, the charging device 30Y, the developing device 50Y and the charge removing device 61Y are formed integrally, as a single unit, into a process cartridge 95Y. The process cartridge 95Y can be pushed into and pulled out of the main body 101 along guide rails, not shown, fixed to the main body 101. The process cartridge 95Y is thus detachably mountable onto the main body 101.

When pushed into the main body 101, the process cartridge 95Y is loaded and positioned at a predetermined position suitable for image formation. Integrating thus various elements into a process cartridge allows handling the process cartridge as a replacement part. This improves dramatically maintenance characteristics, and is hence highly preferable.

Among the photoconductive drum 20Y, the cleaning device 40Y, the charging device 30Y, the developing device 50Y and the charge removing device 61Y, the process cartridge 95Y comprises at least the photoconductive drum 20Y and one of the other elements, formed as a single unit that is detachably mounted on the main body 101.

The photoconductive drum 20Y comprises a tube of aluminum or the like, on the surface of which there is formed an organic photoconductive layer that imparts photoconductivity to the photoconductive drum 20Y. The photoconductive drum 20Y is rotationally driven in the B1 direction by way of driving means, not shown.

The charging device 30Y comprises a wire 31*a*Y, as a discharge wire, for discharge over the photoconductive drum 20Y, as the discharge object, and a casing 31*b*Y of the wire 31*a*Y. To the wire 31*a*Y there are connected voltage application means, not shown, for applying a predetermined voltage that elicits discharge in the wire 31*a*Y. Discharge takes place at a charging region facing the photoconductive drum 20Y, whereupon the surface of the photoconductive drum 20Y becomes charged with a predetermined polarity.

In the present invention, thus, there is employed a scorotron-type contactless charging system using the wire 31*a*Y, although contactless charging systems other than scorotron using the wire 31*a*Y may also be used.

The charging device 30Y is explained in detail next.

An exhaust duct, not shown, is disposed on the side of the main body 101, as a treatment means for treating the ozone and discharge products generated when the charging device 30Y is driven.

The primary transfer roller 12Y has a shaft 37Y rotatably supported on the main body 101, the shaft 37Y being the rotation center of the primary transfer roller 12Y. A bias control means and bias applying means, not shown, comprising a power supply as a primary transfer voltage application power supply, apply a predetermined voltage, appropriate for primary transfer, to the primary transfer roller 12Y.

The optical scanning device 8 illustrated in FIG. 1, irradiates a laser light beam L, optically modulated in accordance with image information, onto a region between a charging region and a developing region on the photoconductive drum 20Y, as illustrated in FIG. 2, to expose thereby the surface of the photoconductive drum 20Y after having been charged by the charging roller 31Y. An electrostatic latent image is thus formed that is then made visible, as a yellow toner image, by the developing device 50Y.

The cleaning device 40Y comprises a cleaning case 43Y having an opening at a portion facing the photoconductive drum 20Y; a brush roller 45Y, as a cleaning rotating brush, abutting the photoconductive drum 20Y, for scraping waste such as residual toner, carrier, paper dust and the like off the photoconductive drum 20Y, to clean thereby the latter; and a cleaning blade 41Y abutting the photoconductive drum 20Y at a position more downstream, in the rotation direction B1 of the photoconductive drum 20Y, than the brush roller 45Y, as a blade for cleaning the photoconductive drum 20Y by scraping off material adhered to the photoconductive drum 20Y.

The cleaning device 40Y comprises also a discharge screw 42Y, rotatably supported on the cleaning case 43Y, that makes up part of a waste toner path, not shown, for transporting waste, such as waste toner or the like removed or scraped by the brush roller 45Y and the cleaning blade 41Y, towards a waste toner tank, not shown.

The charge removing device 61Y removes the charge on the photoconductive drum 20Y after primary transfer, to leave the surface of the photoconductive drum 20Y in an electrically clean state such that the cleaning device 40Y can remove easily material adhered to the surface of the photoconductive drum 20Y. The constitution of the charge removing device 61Y is identical to that of the charging device 30Y.

The developing device 50Y comprises a developing case 55Y having an opening at a portion facing the photoconductive drum 20Y; a developing roller 51Y having a part thereof exposed to the photoconductive drum 20Y, through the opening of the developing case 55Y, and disposed opposite the photoconductive drum 20Y, close to the latter, the developing roller 51Y functioning as a developer carrier for carrying a two-component developer (hereinafter, developer) comprising toner and a carrier; and a developing blade 52Y, in the form of a doctor blade, as a regulating member for regulating the developer on the developing roller 51Y to a certain height.

The developing device 50Y further comprises a first transport screw 53Y and a second transport screw 54Y, disposed opposite each other at the lower portion of the developing case 55Y, as developer supply members for stirring the developer and supplying the developer to the developing roller 51Y by being rotationally driven in mutually opposite directions; a partition wall 57Y provided between the first transport screw 53Y and the second transport screw 54Y; and a first storage chamber 58Y and a second storage chamber 59Y, partitioned by the partition wall 57Y, that make up a developer storage portion, as a developer storage container that houses the first transport screw 53Y and the second transport screw 54Y.

The developing device 50Y further comprises, for instance, a toner hopper 80Y where yellow toner is stored; a toner replenishing opening 87Y opened in the developing case 55Y, whereby the toner hopper 80Y communicates with the second storage chamber 59Y; and a toner concentration detecting sensor 56Y as a toner concentration detection means for measuring the concentration of toner in the developer.

The developing device 50Y further comprises bias application means, not shown, for applying a DC-component developing bias; developing driving means, not shown, for driving the developing roller 51Y; transport driving means, not shown, for rotationally driving the first transport screw 53Y and the second transport screw 54Y in mutually opposite directions; and toner replenishing means, not shown, for replenishing toner to the toner hopper 80Y and the second storage chamber 59Y.

The developing device 51Y comprises a magnet roller 81Y, as a magnetic field generating means: and a non-magnetic developing sleeve 82Y, inside which the magnet roller 81Y is provided, driven in the C1 direction, i.e. the clockwise direction in FIG. 2, by the developing driving means.

The magnet roller 81Y comprises a plastic roller, not shown, fixed to the developing case 55Y; and a plurality of magnet blocks, which are individual magnets, forming a plurality of magnetic poles embedded in the plastic roller.

The developing sleeve 82Y is rotatably supported on the developing case 55Y and the magnet roller 81Y. The bias application means applies a developing bias of appropriate magnitude between the developing sleeve 82Y and the photoconductive drum 20Y. The gap between the developing sleeve 82Y and the photoconductive drum 20Y in the developing region, i.e. the developing gap, is set to 0.3±0.05 mm.

The developing blade 52Y is formed of a SUS material. The gap between the developing sleeve 82Y and the developing blade 52Y, i.e. the doctor gap, is set to 0.5±0.04 mm.

The first transport screw 53Y and the second transport screw 54Y are disposed in the width direction of the developing roller 51Y, i.e. a direction perpendicular to the paper in FIG. 2, which corresponds to the longitudinal direction of the developing roller 51Y.

The first transport screw 53Y is disposed opposite the developing roller 51Y, adjacent thereto. Upon being rotationally driven by the transport driving means, the first transport screw 53Y transports developer from inside the first storage chamber 58Y, in a direction from the front towards the back of the paper in FIG. 2, to supply the developer to the developing roller 51Y. The developer being thus transported by the first transport screw 53Y up to the vicinity of an end portion within the first storage chamber 58Y passes through an opening, not shown, formed at one end of the partition wall 57Y, and enters into the second storage chamber 59Y, to be delivered to the second transport screw 54Y.

The second transport screw 54Y is disposed on the opposite side of the developing roller 51Y, flanking the first transport screw 53Y. The developer fed from the first storage chamber 58Y as a result of the rotational driving by the transport driving means, is transported in the second storage chamber 59Y in an opposite direction to that of the first transport screw 53Y. The developer being thus transported by the second transport screw 54Y up to the vicinity of an end portion within the second storage chamber 59Y passes through an opening, not shown, formed at the other end of the partition wall 57Y, and enters into the first storage chamber 58Y, to be delivered to the first transport screw 53Y.

When toner is replenished out of the toner hopper 80Y via the toner replenishing opening 87Y, the second transport screw 54Y transports freshly replenished toner while stirring and mixing the latter into the developer. The replenished toner spreads gradually, as a result, throughout the developer in the developing device 50Y. During that process, the supplied toner becomes charged on account of friction with other toner particles and the carrier in the developer.

The present invention uses positively charged toner. That is, the toner has positive polarity when charged with regular charge, and negative polarity when charged with reverse charge.

The developer transported by the first transport screw 53Y is pumped up by the magnet roller 81Y, and becomes carried on the surface of the developing roller 51Y at the region where the first transport screw 53Y and the developing roller 51Y face each other.

The developing roller 51Y, in which the developing blade 52Y regulates the amount of developer carried i.e. a developer layer thickness, carries the developer, in an appropriate amount as adjusted by the developing blade 52Y, to a developing region located between the developing roller 51Y and the photoconductive drum 20Y, as a result of the rotation of the developing roller 51Y and the developing bias applied by the bias application means.

In the developing region, the developer is napped on the developing sleeve 82Y by the magnet roller 81Y, to form a magnetic brush. The bias of the bias application means causes then a developing potential to act on the toner within the developer, in particular the toner at the tips of the magnetic brush, whereupon the toner migrates electrostatically from the surface of the magnetic carrier to the electrostatic latent image formed on the surface of the photoconductive drum 20Y. As a result, the electrostatic latent image is developed into a visible yellow toner image. Toner charging is also assisted by the regulating action of the developing blade 52Y.

The developer, with some yellow toner consumed in the developing process, returns into the developing device 50Y accompanying the rotation of the developing roller 51Y.

In the present invention, the bias application means applies a DC-component bias, but the developing bias may also comprise an AC component, or an AC component superposed onto a DC component.

In the developing process carried out in the developing device 50Y, thus, developer stirred and transported by the first transport screw 53Y and the second transport screw 54Y is pumped up onto the developing sleeve 82Y on account of the magnetic forces of the magnet roller 81Y, to become carried on the developing sleeve 82Y. The developer is then transported up to the developing region, facing the photoconductive drum 20Y, where toner is supplied to the latent image on the photoconductive drum 20Y. After development, the developer, out of which some toner has been consumed, is discharged from the surface of the developing sleeve 82Y into the first storage chamber 58Y, and is stirred with further developer, in the first storage chamber 58Y and the second storage chamber 59Y, by the first transport screw 53Y and the second transport screw 54Y. The developer is then pumped up once more onto the surface of the developing sleeve 82Y, to repeat the above cycle. The magnet blocks are disposed in such a manner so that the above cycle is repeated.

Toner concentration decreases since the toner in the developer is consumed ongoingly in the above cycle. The drop in toner concentration is detected by the toner concentration detecting sensor 56Y. The toner concentration detecting sensor 56Y is a magnetic permeability sensor that measures toner concentration on the basis of the magnetic permeability of the developer.

When the proportion of carrier increases, on account of a lower toner concentration, in a developer comprising toner and a magnetic carrier, the magnetic permeability of the developer increases. When toner concentration is high, by contrast, the proportion of carrier decreases, as does the magnetic permeability of the developer. Therefore there is a relationship of substantially direct proportionality between decrease in toner concentration and rise in output voltage Vout.

Therefore, when the control means detects a drop in toner concentration, on the basis of an output voltage Vout from the toner concentration detecting sensor 56Y, the control means drives the toner replenishing means to supply toner from the toner hopper 80Y to the second storage chamber 59Y, until the output voltage Vout acquires again a predetermined magnitude, whereby toner concentration in the developer is controlled within a predetermined range suitable for development. This contributes as a result to obtaining high-quality images.

The developer will be explained in detail further on.

In addition to the wire 31*a*Y and the casing 31*b*Y, the charging device 30Y comprises a discharge wire cleaning device for cleaning the wire 31*a*Y. The constituent elements of the charging device 30Y will be explained hereinafter omitting the suffix Y in the reference numerals.

Figure 3:
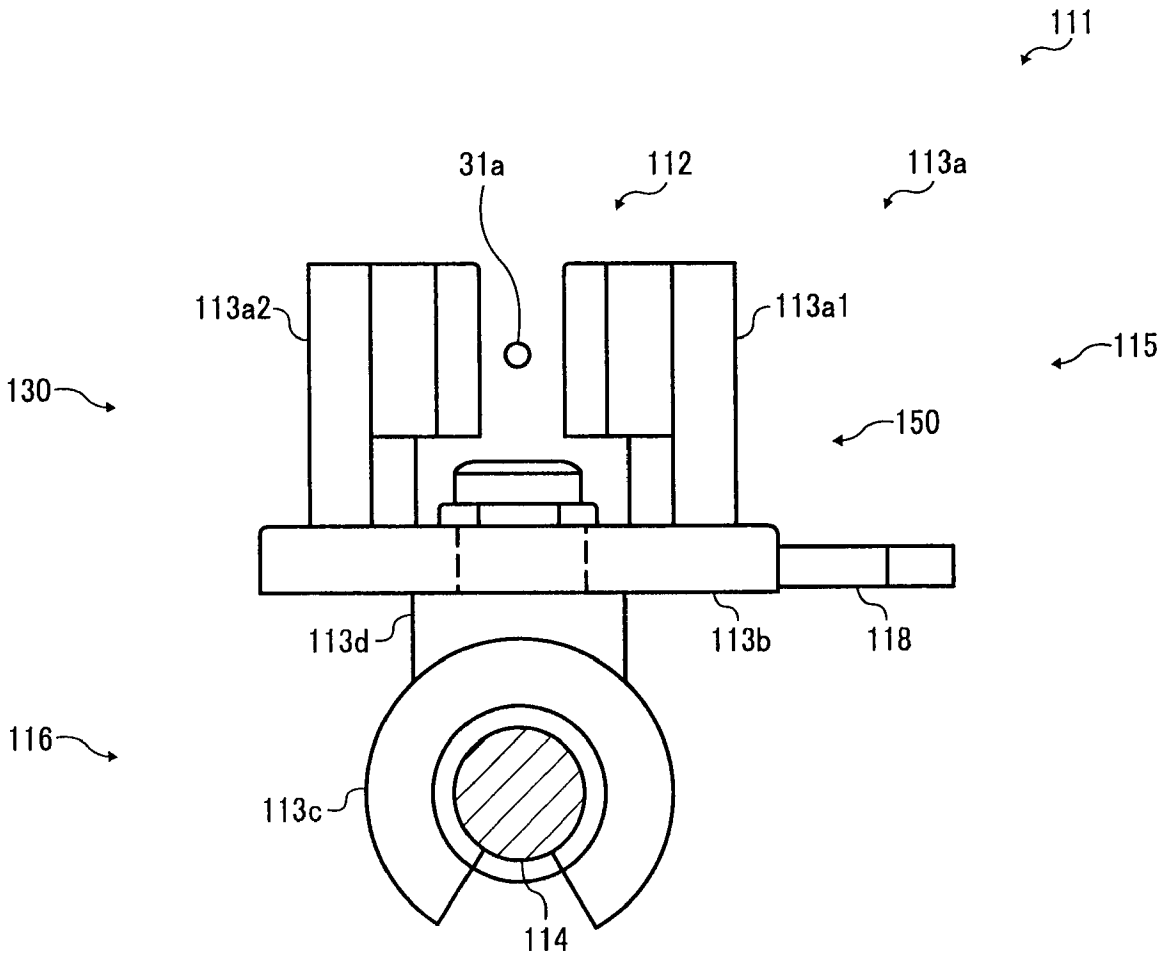
FIG. 3 is a front-view diagram illustrating the constitution of a discharge wire cleaning device comprised in the charging device.
Figure 4:
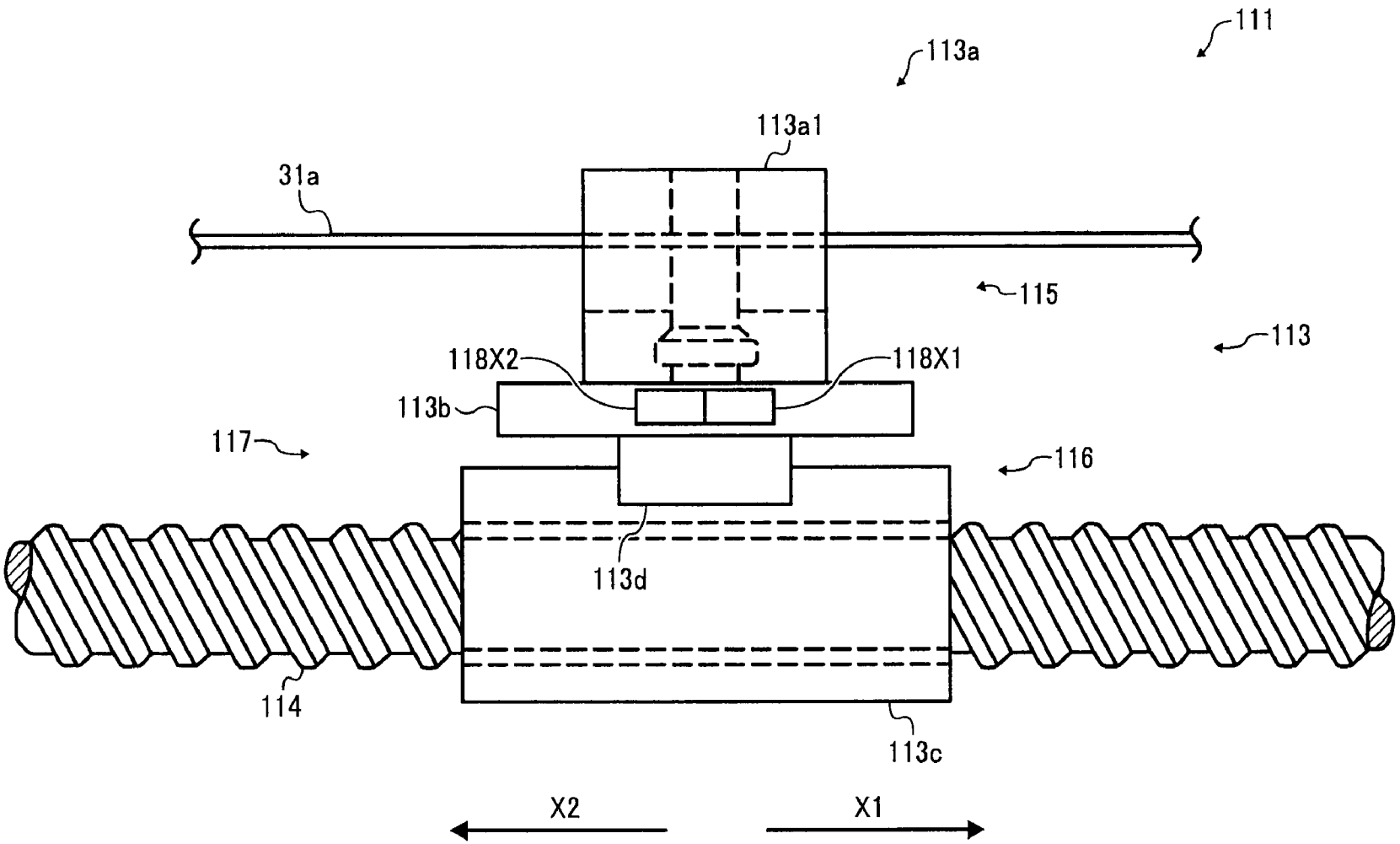
FIG. 4 is a side-view diagram illustrating the constitution of the discharge wire cleaning device.
Figure 5:
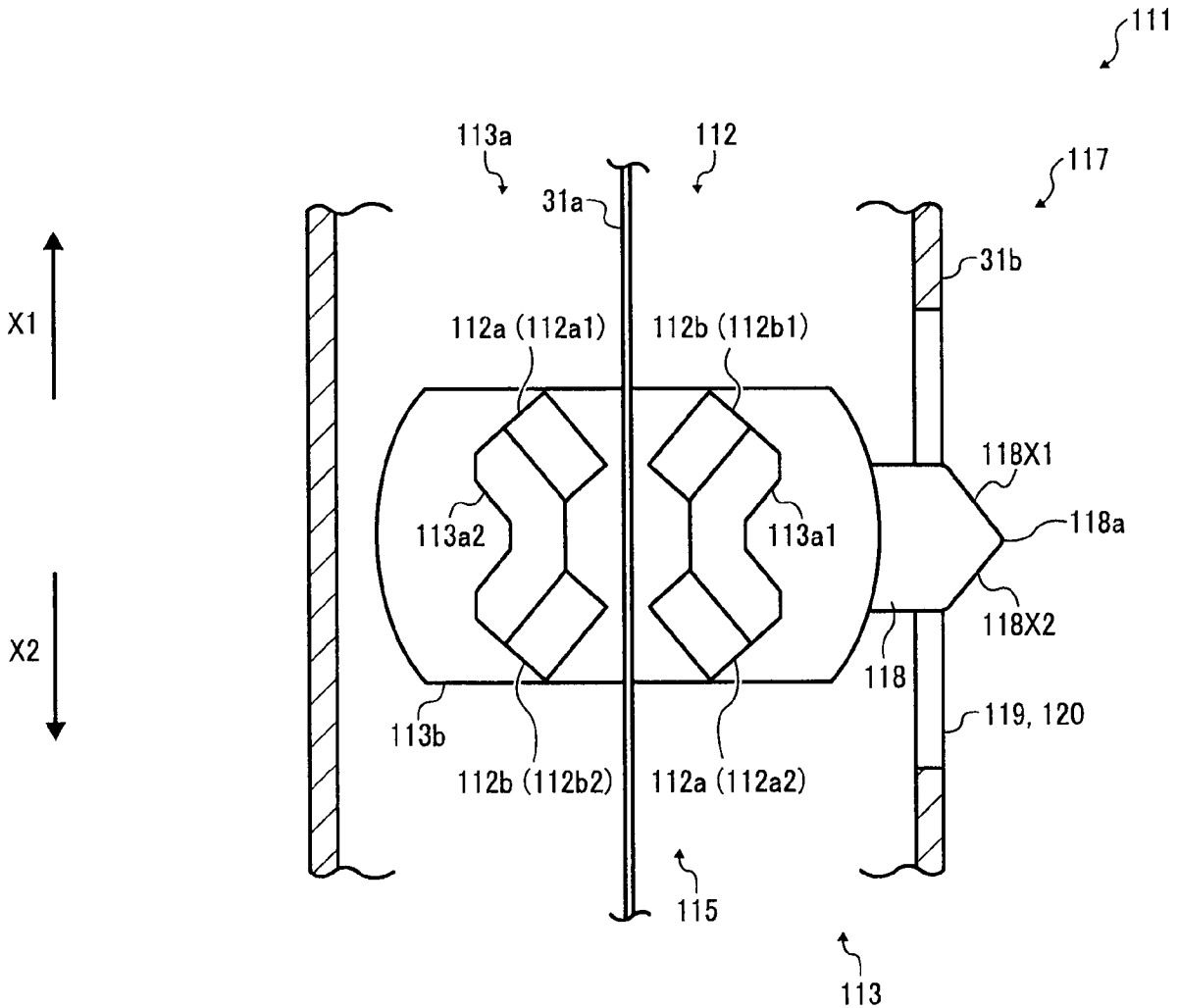
FIG. 5 is a plan-view diagram illustrating the constitution of the discharge wire cleaning device.

As illustrated in FIG. 3, 4 or 5, a discharge wire cleaning device 111 comprises a cleaning member 112 moving reciprocally along a XY direction in which the wire 31*a* is stretched; a reciprocating member 113, for supporting the cleaning member 112, and moving reciprocally along the wire 31*a* together with the cleaning member 112; a feeding screw rod 114, as a rotating shaft, for causing the reciprocating member 113 to move reciprocally through forward and reverse rotation of the screw rod 114; and a motor as a driving source, not shown, for rotationally driving the screw rod 114. The arrows X1, X2 in FIGS. 4 and 5 denote the direction X1X2 along which the wire 31*a* is stretched, as well as the forward direction X1 and the backward direction X2 of the reciprocating member 113. The screw rod 114 is omitted in FIG. 5.

The reciprocating member 113 comprises a support portion 113*a* for supporting the cleaning member 112; a flat plate-like base 113*b* on one face of which the support portion 113*a* is protrusively provided; a screw portion 113*c* that is screwed onto the screw rod 114; and a connecting portion 113*d*, positioned on the other face of the base 113*b*, rotatably supported relative to the screw portion 113*c*, for connecting the base 113*b* and the screw portion 113*c*. The support portion 113*a* and the base 113*b* make up a cleaner 115 as a support member. The screw portion 113*c* and the connecting portion 113*d* make up a slider 116 for reciprocally moving the cleaner 115 along the wire 31*a*.

The support portion 113*a* comprises a first support portion 113*a*1 and a second support portion 113*a*2 opposing each other with the wire 31*a* in between. The base 113*b* has a projection, not shown, on the opposite side of the support portion 113*a*, such that the connecting portion 113*d* is rotatably fitted onto the projection. By way of the connecting portion 113*d*, the base 113*b* is rotatably supported within a plane facing the photoconductive drum 20, i.e. within a plane parallel to the paper in FIG. 5. The photoconductive drum 20 is located at an overhead position in FIG. 3 and FIG. 4, and at a front position, as one looks at the paper, in FIG. 5. The cleaner 115 can thus rotate within a plane that faces the photoconductive drum 20.

The screw portion 113*c* is shaped as a cylinder, cut out at the bottom, and having a spiral thread, not shown, formed on the inner peripheral face, by means of which the screw portion 113*c* is screwed onto the screw rod 114. The slider 116 moves thus in the X1 direction during forward rotation of the screw rod 114, and in the X2 direction during reverse rotation of the screw rod 114.

The cleaning member 112 comprises a first cleaning portion 112*a* that engages with the wire 31*a*, sliding along the latter in contact therewith, during forward travel, and a second cleaning portion 112*b* that engages with the wire 31*a*, sliding along the latter in contact therewith, during backward travel.

The first cleaning portion 112*a* comprises a wire cleaner pad 112*a*1, as a cleaning member, positioned on one side of the wire 31*a*, downstream in the X1 direction; and a wire cleaner pad 112*a*2, as a cleaning member, positioned on the other side of the wire 31*a*, upstream in the X1 direction.

The second cleaning portion 112*b* comprises a wire cleaner pad 112*b*1, as a cleaning member, positioned on one side of the wire 31*a*, downstream in the X1 direction; and a wire cleaner pad 112*b*2, as a cleaning member, positioned on the other side of the wire 31*a*, upstream in the X1 direction.

Thus, the first cleaning portion 112*a* and the second cleaning portion 112*b* have each two members that engage with the wire 31*a* from mutually opposing sides.

Figure 6:
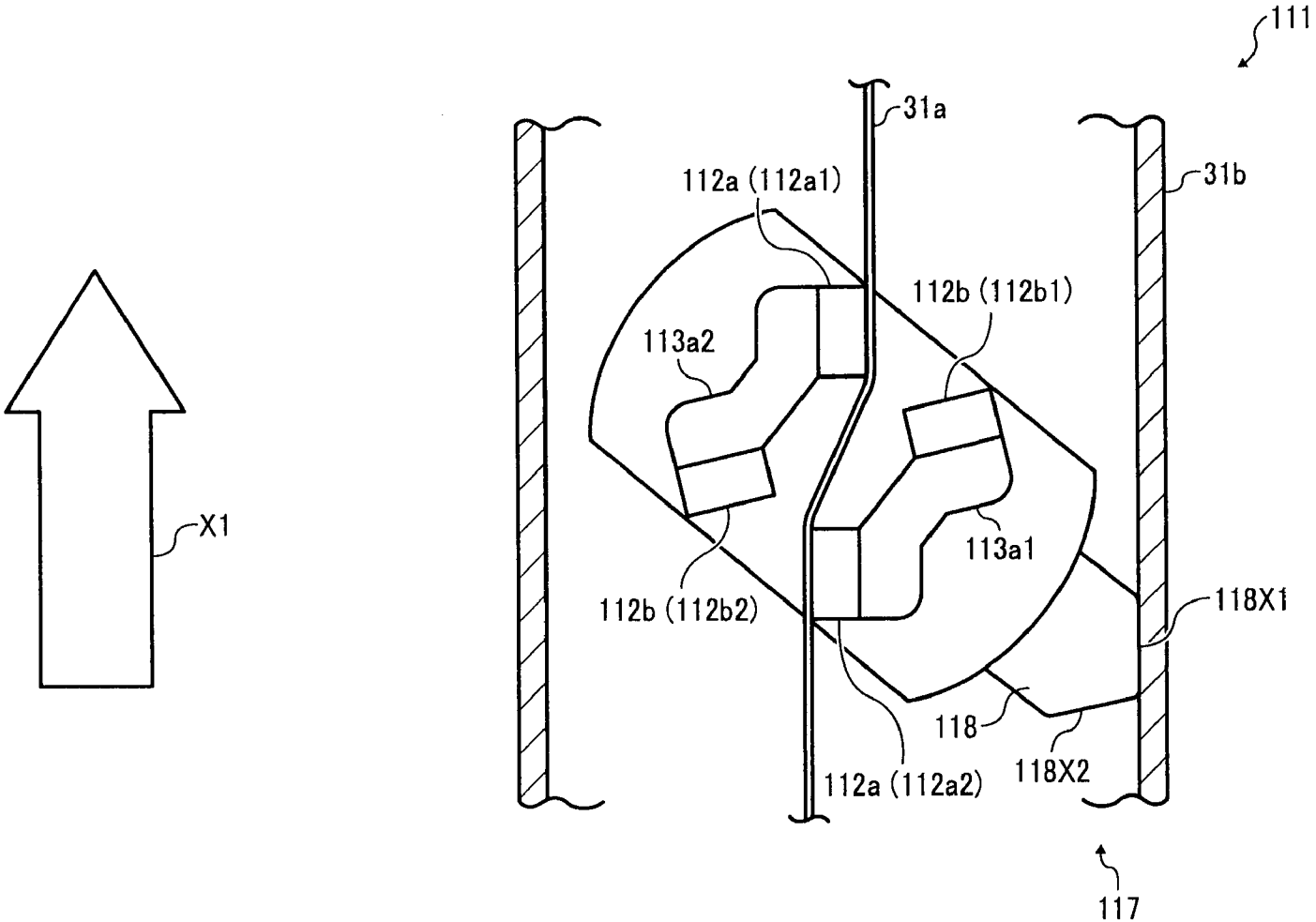
FIG. 6 is a plan-view diagram illustrating a first orientation of a support member of the discharge wire cleaning device.
Figure 7:
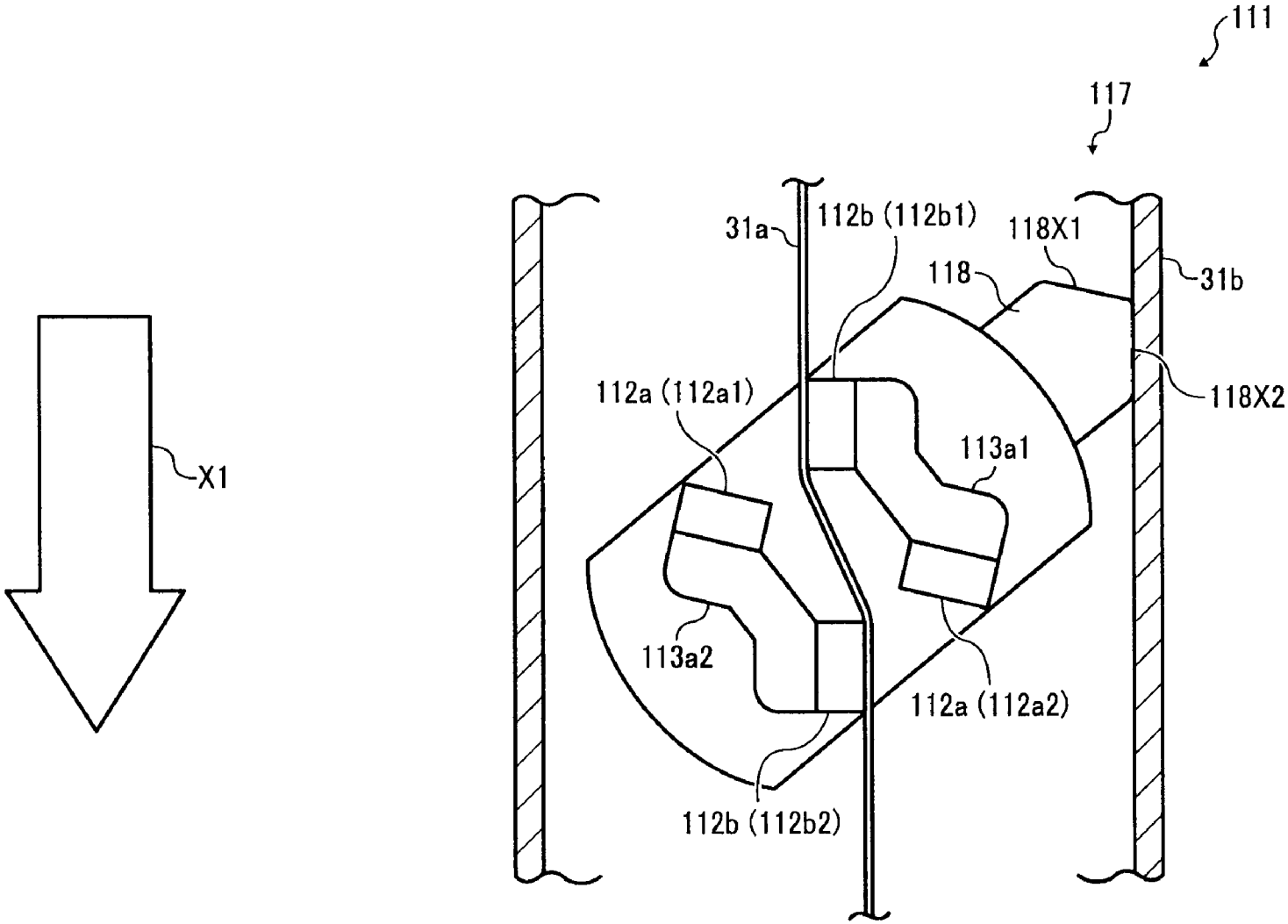
FIG. 7 is a plan-view diagram illustrating a second orientation of a support member of the discharge wire cleaning device.

The wire cleaner pad 112*b*1 and the wire cleaner pad 112*a*2 are supported on the first support portion 113*a*1, and the wire cleaner pad 112*a*1 and the wire cleaner pad 112*b*2 are supported on the second support portion 113*a*2. The cleaner 115 can adopt a first orientation, in which the first cleaning portion 112*a* is engaged with the wire 31*a*, as illustrated in FIG. 6, and a second orientation, in which the second cleaning portion 112*b* is engaged with the wire 31*a*, as illustrated in FIG. 7.

The cleaner 115 takes up the first orientation at the start point of the forward travel and the second orientation at the start point of the backward travel. The action of the cleaner 115 is effected by way of a swinging means 117, which is at least partially depicted in FIGS. 3 to 19, comprised in the discharge wire cleaning device 111.

The swinging means 117 comprises the slider 116; the casing 31*b*, in the form of parallelly arrayed members provided substantially perpendicular to the direction X1X2 along which the wire 31*a* is stretched; a protruding claw 118, as a first engaging portion, protrusively formed on the base 113*b*; holes 119, 120, formed as recesses in the casing 31*b*, and disposed at the start points of the forward or backward travel of the cleaner 115, in such a way so as to accommodate the claw 118, as illustrated in FIG. 5, the holes 119, 120 being a second locking portion for switching between the first orientation and the second orientation of the cleaner 115 by engaging with the claw 118; and attitude control members 121, 122, illustrated in FIGS. 8 to 19, for, with the claw 118 inserted in the holes 119, 120, controlling the attitude of the cleaner 115 by engaging with the base 113*b*, in such a way so as to separate both the first cleaning portion 112*a* and the second cleaning portion 112*b* from the wire 31*a*.

In FIG. 5, the start points of the forward and backward travel of the cleaner 115 are not differentiated in the figure, and the same portion is denoted as the holes 119, 120. In actuality, however, the hole 119 is positioned at the start point of the forward travel of the cleaner 115, i.e. the end point of the backward travel, as illustrated in FIGS. 8 to 10 or 17 to 19. Meanwhile, the hole 120 is positioned at the start point of the backward travel of the cleaner 115, i.e. the end point of the forward travel, as illustrated in FIGS. 11 to 16.

The attitude control member 121 is positioned at the start point of the forward travel of the cleaner 115, i.e. the end point of the backward travel, as illustrated in FIGS. 8 to 10 or 17 to 19. Meanwhile, the attitude control member 122 is positioned at the start point of the backward travel of the cleaner 115, i.e. the end point of the forward travel, as illustrated in FIGS. 11 to 16.

The claw 118 comprises sides 118X, 118Y on both sides of an apex 118*a*. The side 118X is positioned more downstream, in the X1 direction, than the apex 118*a*. The side 118Y is positioned more downstream, in the X2 direction, than the apex 118*a*. In the present embodiment, the recesses are provided in the form of the hole 119 of the hole 120 that are opened in the casing 31*b*. As explained below, however, the term recess in the present invention denotes a shape that can accommodate a projection such as the claw 118 and that allows a support member such as the cleaner 115, comprising such a projection, to pivot by engaging with the recess, at the edge thereof. The recess is thus not limited to a hole shape, and as its name implies can have any recessed shape.

As illustrated in FIG. 5, 8, 13, 14 or 19, the claw 118 is disengaged from the casing 31*b*, at the start point of the forward and backward travel of the cleaner 115, through engaging of the base 113*b* with the attitude control member 121 or the attitude control member 122, whereby the cleaning member 112 becomes disengaged as well from the wire 31*a*.

When the cleaner 115 starts the forward travel, the claw 118 engages with the edge of the hole 119 on the downstream side of the X1 direction, whereupon the cleaner 115 swings within a plane facing the photoconductive drum 20. During the forward travel of the cleaner 115, the side 118X slides in contact with the inward side face of the casing 31*b*, as illustrated in FIG. 6, to keep the cleaner 115 in the first orientation.

When the cleaner 115 starts the backward travel, the claw 118 engages with the edge of the hole 120 on the downstream side of the X2 direction, whereupon the cleaner 115 swings within a plane facing the photoconductive drum 20. During the forward travel of the cleaner 115, the side 118Y slides in contact with the inward side face of the casing 31*b*, as illustrated in FIG. 7, to keep the cleaner 115 in the second orientation.

The wire cleaner pads 112*a*1, 112*a*2, 112*b*1, 112*b*2 comprise each an elastic member that can deform so as to hug the shape of the wire 31*a*. Specifically, the wire cleaner pads 112*a*1, 112*a*2 comprised in the first cleaning portion 112*a* have a porous foamed member as the elastic member, while the wire cleaner pads 112*b*1, 112*b*2 comprised in the second cleaning portion 112*b* have a felt-like nonwoven fabric as the elastic member.

Figure 20:
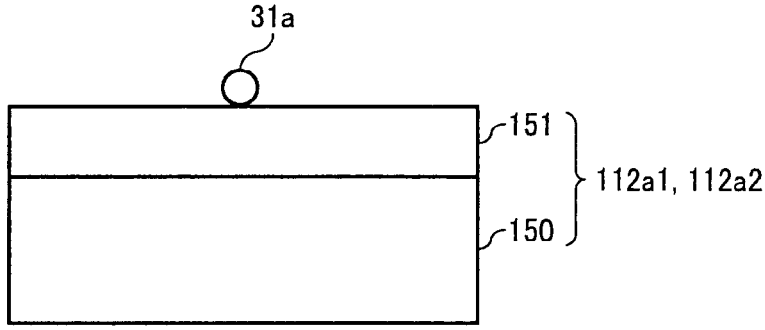
FIG. 20 is an enlarged cross-sectional diagram of the cleaning member comprised in the charging device.

As illustrated in FIG. 20, the wire cleaner pads 112*a*1, 112*a*2 comprised in the first cleaning portion 112*a* have a porous foamed member 150 and an abrasive-containing layer 151, integrally formed with the porous foamed member 150, that abuts the wire 31*a*. The abrasive-containing layer 151, which is a polyester nonwoven fabric impregnated throughout with an abrasive, has the function of polishing the wire 31*a*. The abrasive may also be kneaded into the abrasive-containing layer 151.

When the cleaning member 112 has the function of polishing the wire 31*a*, by means of the wire cleaner pads 112*a*1, 112*a*2, that have the function of polishing the wire 31*a*, the porous foamed member 150 may comprise an abrasive, or have an abrasive kneaded thereinto, instead of, or alongside with, an abrasive impregnated or kneaded into the abrasive-containing layer 151.

The abrasive-containing layer 151 in the cleaning member 112 is advantageous in that the cleaning function of the latter can be preserved at all times, as the wire 31*a* bites into the wire cleaner pads 112*a*1, 112*a*2 on account of the elasticity of the porous foamed member 150.

The porous foamed member can comprise a sponge or the like.

The abrasive-containing layer 151 is explained further on.

The felt-like nonwoven fabric that is the material of the wire cleaner pads 112*b*1, 112*b*2 comprised in the second cleaning portion 112*b* adsorbs and retains the waste adhered to the wire 31*a*. The material of the wire cleaner pads 112*b*1, 112*b*2 may be a porous foamed material. This porous foamed material comprises a sponge or the like, as is the case in the first cleaning portion 112*a*. When using a porous foamed material in the wire cleaner pads 112*b*1, 112*b*2, the material is preferably the same that of the porous foamed member 150, from the viewpoint of containing costs.

Waste denotes herein toner and/or paper dust flying off the photoconductive drum 20 or the like, or wafting in the atmosphere within the image forming apparatus 100, as well as toner or the like stripped from the wire 31*a*, by the polishing function of the first cleaning portion 112*a* and polishing dust or the like generated during polishing by the first cleaning portion 112*a*, and which adheres to the wire 31*a*, affecting discharge. The material of the wire cleaner pads 112*b*1, 112*b*2 comprised in the second cleaning portion 112*b* may be any material, provided that it removes waste from the wire 31*a*, and adsorbs and/or retains that waste.

When the first cleaning portion 112*a* has a first function of polishing the discharge wire, and the second cleaning portion 112*b* has a second function of adsorbing and so forth waste adhered to the discharge wire, as in the present invention, the first cleaning portion 112*a* and the second cleaning portion 112*b* have thus different functions, and cleaning is performed both during the forward and backward travels, which increases as a result cleaning efficiency. In addition, cleaning functions differ between the forward and backward travels. This allows further improving cleaning efficiency. In particular, the waste that is stripped from the wire 31*a* through polishing by the first cleaning portion 112*a*, during the forward travel, is wiped off the wire 31*a* by the second cleaning portion 112*b* during the backward travel. Cleaning efficiency becomes very high as a result.

When the function of the first cleaning portion 112*a* and the second cleaning portion 112*b* differ, the second cleaning portion 112*b* may have a polishing function and the first cleaning portion 112*a* an adsorbing function and so forth, unlike in the present embodiment. However, the waste stripped by the polishing function is preferably wiped off immediately once the cleaning operation is over, upon a single or plural forward and backward travels of the cleaner 115. Therefore, it is preferable to impart the first cleaning portion 112*a*, which operates during the forward travel, with the polishing function, and to impart the second cleaning portion 112*b*, which operates during the backward travel, with the adsorbing function and so forth, as in the present embodiment. From the viewpoint of costs, the first cleaning portion 112*a* and the second cleaning portion 112*b* may be imparted with the same functions.

Figure 8:
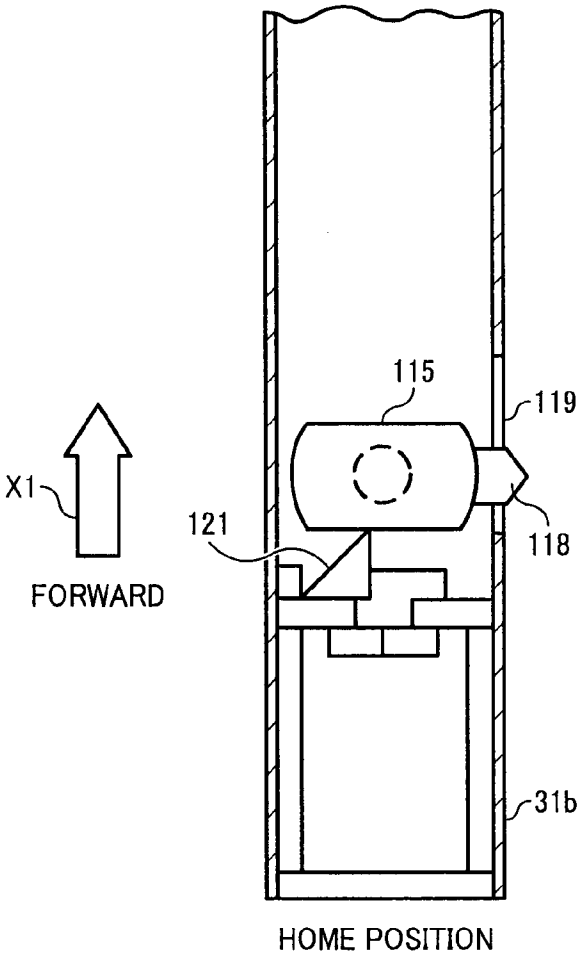
FIG. 8 is a plan-view diagram illustrating the support member occupying a home position when cleaning starts.

In the discharge wire cleaning device 111 having such a constitution, the cleaner 115 becomes disengaged from the casing 31*b*, as a result of which the cleaning member 112 moves away from the wire 31*a*, at the start point of the forward travel, through engaging with the attitude control member 121 and insertion of the claw 118 into the hole 119, as illustrated in FIG. 8. The position occupied by the cleaner 115 in that situation is the home position of the cleaner 115.

Figure 9:
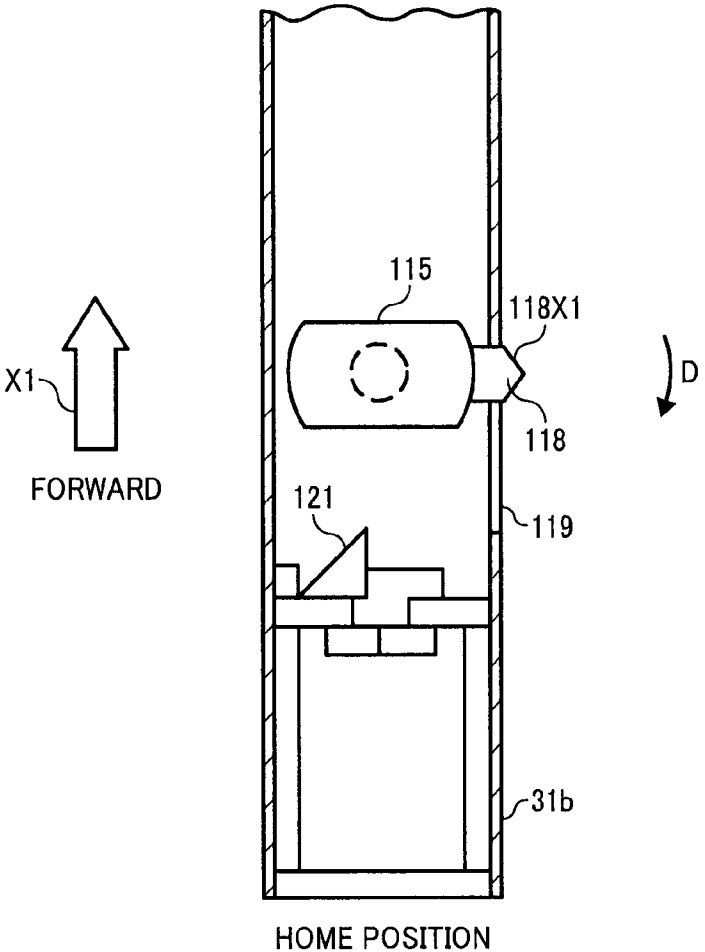
FIG. 9 is a plan-view diagram illustrating a first engaging portion starting to engage with a second engaging portion during forward travel.

When the screw rod 114 is rotated forward, through energizing of the motor, the slider 116 actuates to initiate the forward travel of the cleaner 115, so that the latter starts moving in the X1 direction. When the claw 118 engages with the downstream edge, in the X1 direction, of the hole 119, as illustrated in FIG. 9, further travel of the cleaner 115 in the X1 direction causes the cleaner 115 to start rotating and swinging within a plane that faces the photoconductive drum 20, in the D direction, which is the clockwise direction in the figure, whereupon the first cleaning portion 112 begins engaging with the wire 31*a*.

Figure 10:
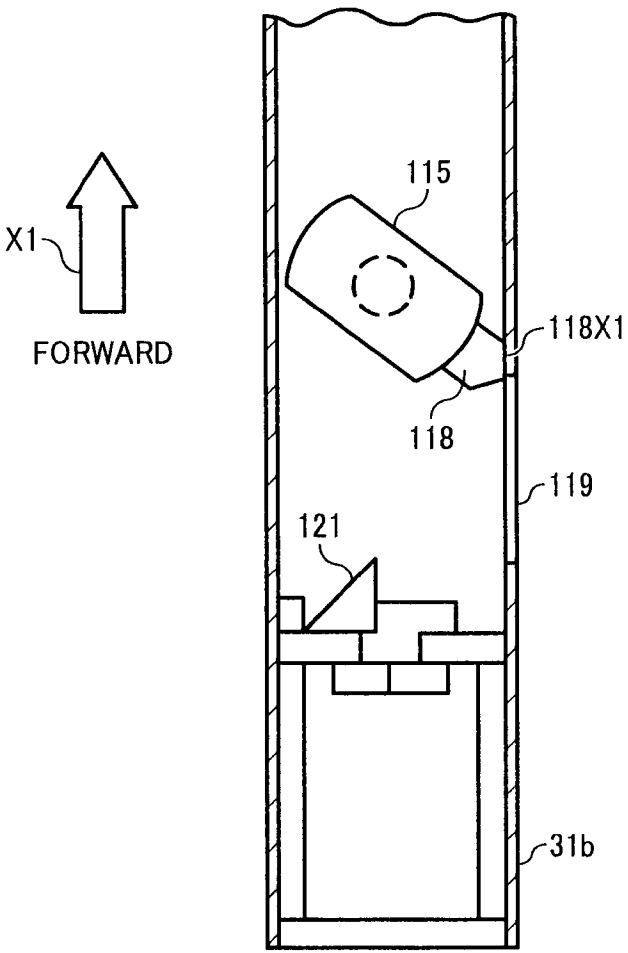
FIG. 10 is a plan-view diagram illustrating the support member as it continues traveling forward while keeping the first orientation.

Upon further travel of the cleaner 115 in the X1 direction, the side 118X engages with the inward edge of the casing 31*b*, as illustrated in FIG. 10. The cleaner 115 continues traveling then in the X1 direction, with the side 118X in sliding contact with that inward edge. In the process, the first cleaning portion 112*a* cleans the wire 31*a*, more specifically, polishes the wire 31*a* and strips waste away from the latter.

Figure 11:
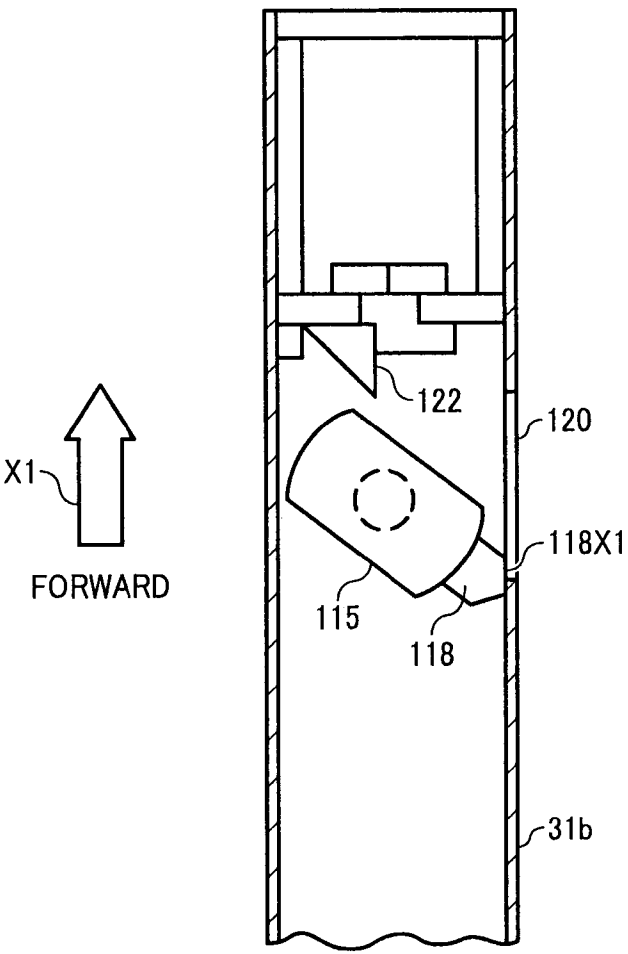
FIG. 11 is a plan-view diagram illustrating the support member as it travels up to the vicinity of the end point of a forward travel.
Figure 12:
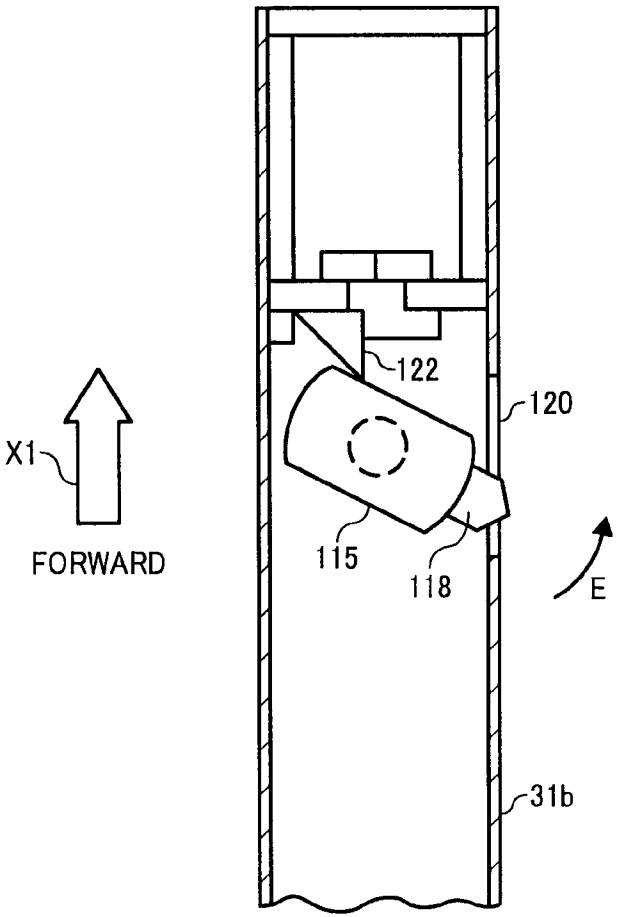
FIG. 12 is a plan-view diagram illustrating the first engaging portion having finished engaging with a casing, during forward travel.

When the cleaner 115 reaches the vicinity of the forward travel end point, as illustrated in FIG. 11, the claw 118 is disengaged from the inward edge of the casing 31*b* and the base 113*b* starts engaging with the attitude control member 122, whereupon the claw 118 gets into the hole 120, as illustrated in FIG. 12. Thereby, the cleaner 115 starts to rotate and swing in the E direction, which is the counterclockwise direction in the figure.

Figure 13:
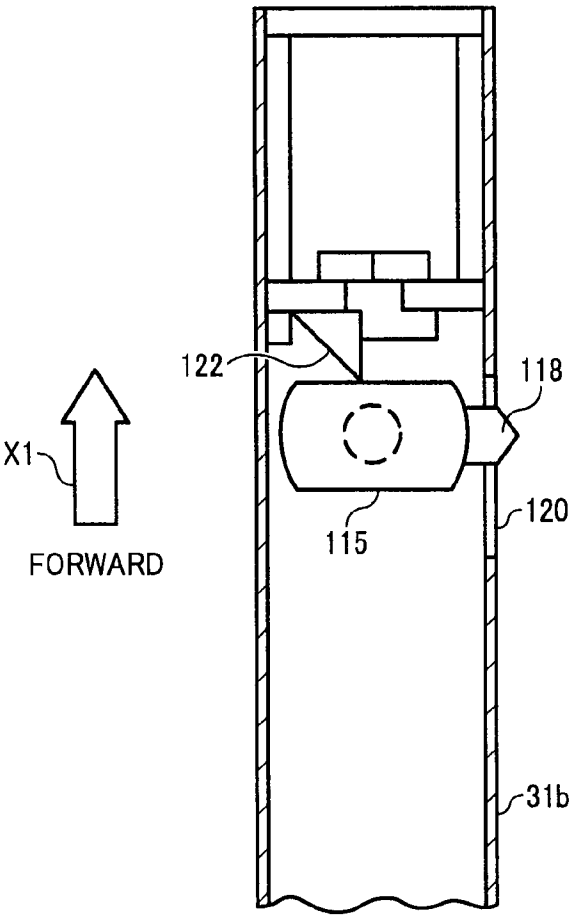
FIG. 13 is a plan-view diagram illustrating the support member at the end point of forward travel.

As the cleaner 115 travels to reach the end of the forward travel, the cleaner 115 rotates and swings in the E direction until the base 113*b* engages with the attitude control member 122, as illustrated in FIG. 13, and the first cleaning portion 112*a* separates from the wire 31*a*. In that situation, the motor stops being energized, to discontinue the rotation of the screw rod 114, as a result of which the cleaner 115 stops traveling in the X1 direction. The cleaner 115 completes thereby the forward travel, and the first cleaning portion 112*a* completes cleaning of the wire 31*a*. Specifically, the polishing step by the first cleaning portion 112*a* is then over.

Figure 14:
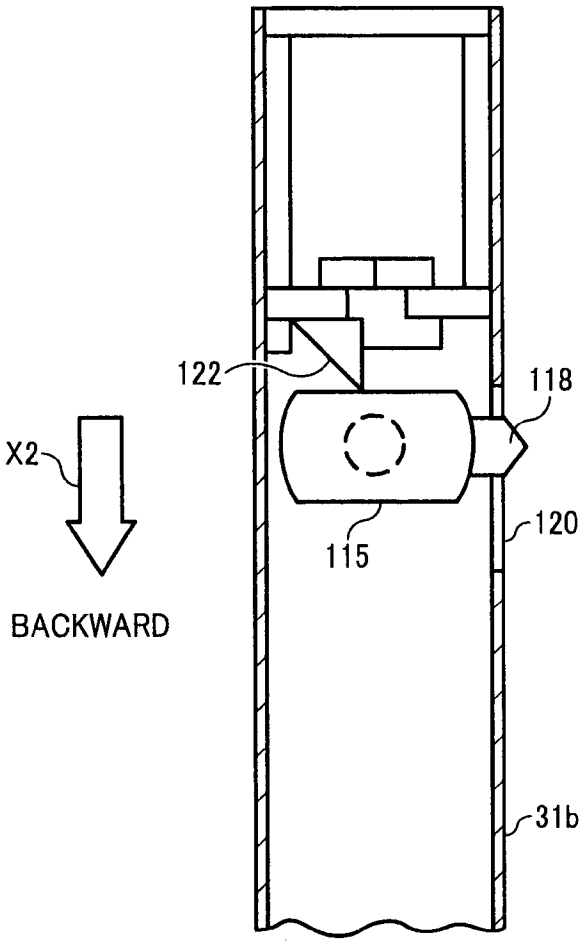
FIG. 14 is a plan-view diagram illustrating the support member at the start point of backward travel.

At the end point of the forward travel, i.e. the start point of the backward travel, the cleaner 115 disengages from the casing 31*b* through engaging of the cleaner 115 with the attitude control member 122 and insertion of the claw 118 into the hole 120, as illustrated in FIG. 13 or FIG. 14, whereupon the cleaning member 112 moves away from the wire 31*a*. After discontinuing motor energizing for the forward travel, the motor starts now being energized for the backward travel, whereupon the screw rod 114 rotates reversely. As a result, the slider 116 actuates to initiate the backward travel of the cleaner 115, and the latter starts moving in the X2 direction.

Figure 15:
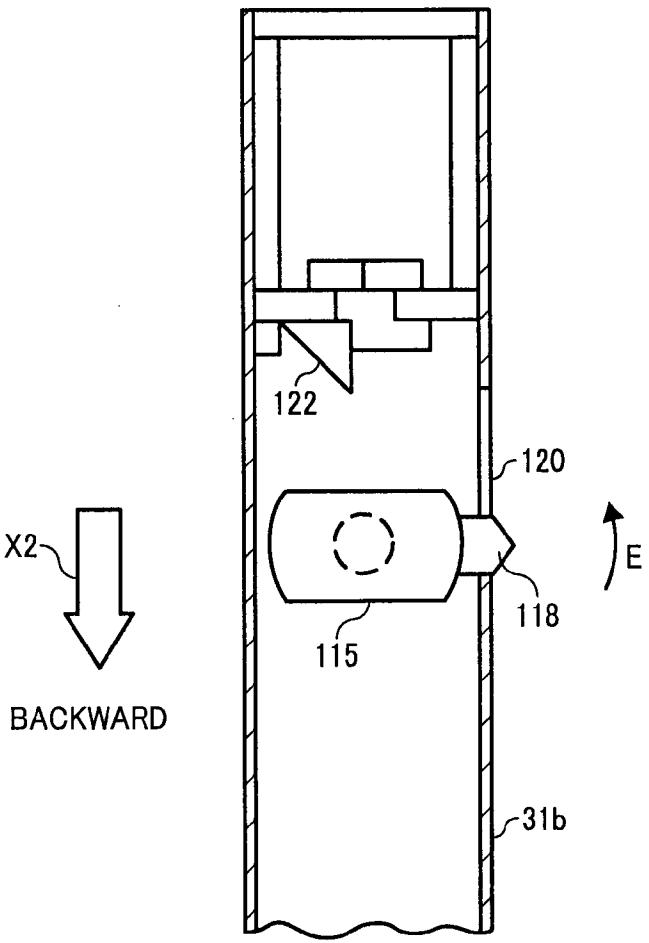
FIG. 15 is a plan-view diagram illustrating the first engaging portion starting to engage with the second engaging portion during backward travel.

When the claw 118 engages with the downstream edge, in the X2 direction, of the hole 119, as illustrated in FIG. 15, further travel of the 115 in the X2 direction causes the cleaner 115 to start rotating and swinging within a plane that faces the photoconductive drum 20, in the E direction, whereupon the first cleaning portion 112 begins engaging with the wire 31*a*.

Figure 16:
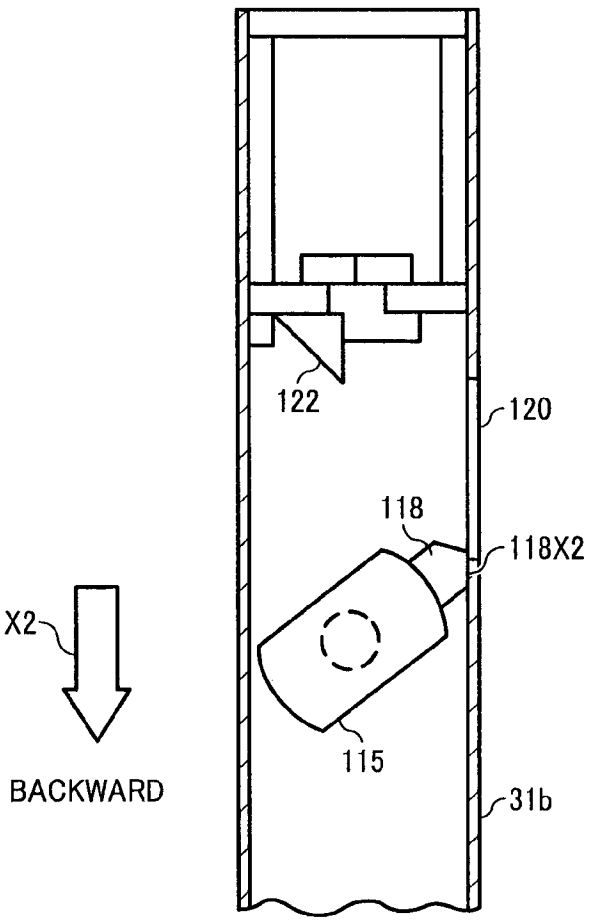
FIG. 16 is a plan-view diagram illustrating the support member as it continues traveling backward while keeping the first orientation.

Upon further travel of the cleaner 115 in the X2 direction, the cleaner 115 continues traveling then in the X2 direction, with the side 118Y in sliding contact with the inward edge, as illustrated in FIG. 16. During that process, the second cleaning portion 112*b* cleans the wire 31*a*, more specifically, adsorbs and retains waste from the wire 31*a*, to remove thereby the waste from the wire 31*a*.

Figure 17:
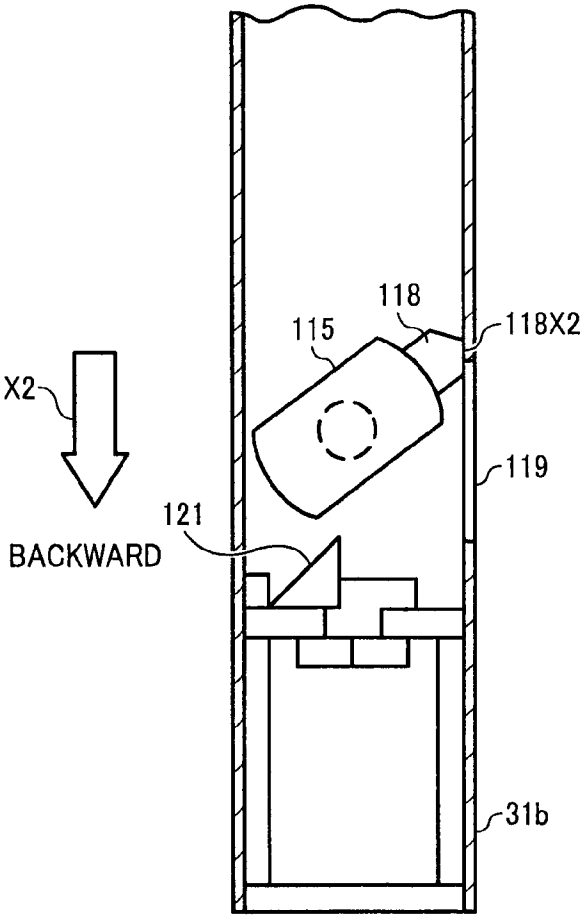
FIG. 17 is a plan-view diagram illustrating the support member as it travels up to the vicinity of the end point of the backward travel.
Figure 18:
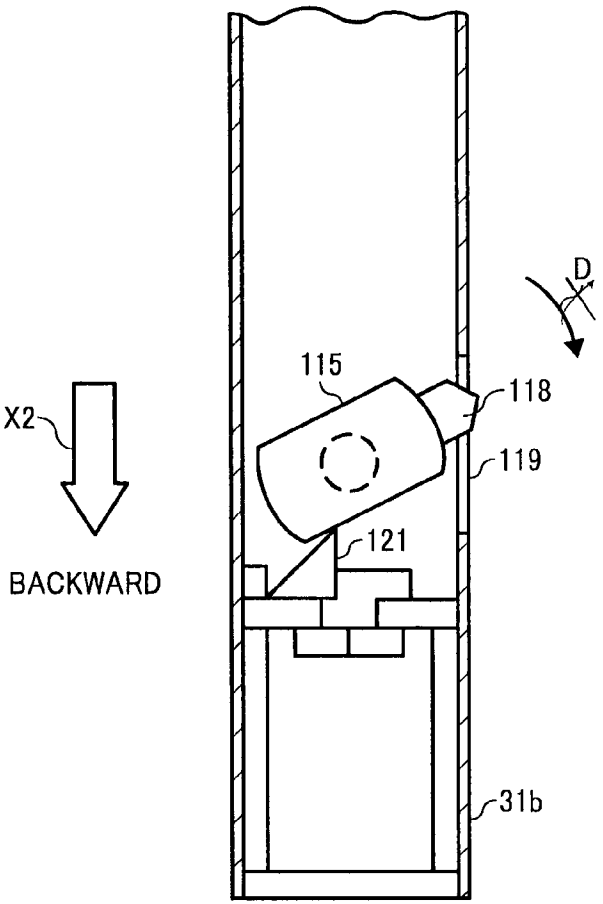
FIG. 18 is a plan-view diagram illustrating the first engaging portion having finished engaging with the casing, during backward travel.

When the cleaner 115 reaches the vicinity of the backward travel end point, as illustrated in FIG. 17, the claw 118 is disengaged from the inward edge of the casing 31*b* and the base 113*b* starts engaging with the attitude control member 121, whereupon the claw 118 gets into the hole 119, as illustrated in FIG. 18. Thereby, the cleaner 115 starts to rotate and swing in the D direction.

Figure 19:
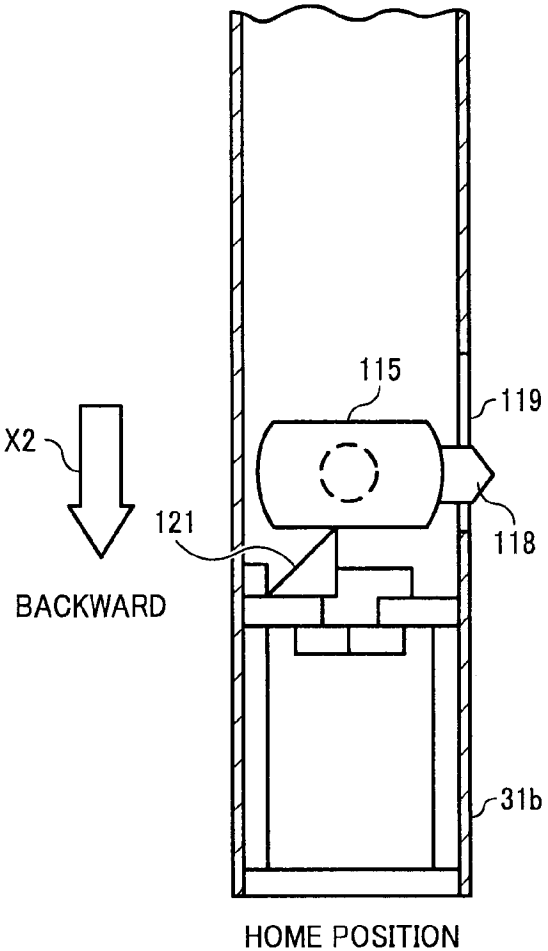
FIG. 19 is a plan-view diagram illustrating the support member occupying the home position when cleaning is over.

As the cleaner 115 travels to reach the end of the backward travel, the cleaner 115 rotates and swings in the D direction until the base 113*b* engages with the attitude control member 121, as illustrated in FIG. 19, and the second cleaning portion 112*b* moves away from the wire 31*a*. In that situation, the motor stops being energized, to discontinue the rotation of the screw rod 114, as a result of which the cleaner 115 stops traveling in the X2 direction.

The cleaner 115 reaches thus the home position, completing the backward travel, and concluding thereby the cleaning operation, specifically the waste adsorption and retention operation, of the wire 31*a* by the second cleaning portion 112*b*. This completes the cleaning operation by the discharge wire cleaning device 111. The cleaning operation by the discharge wire cleaning device 111 may be designed so as to be over after plural forward and backward travels of the cleaner 115.

Figure 21A:
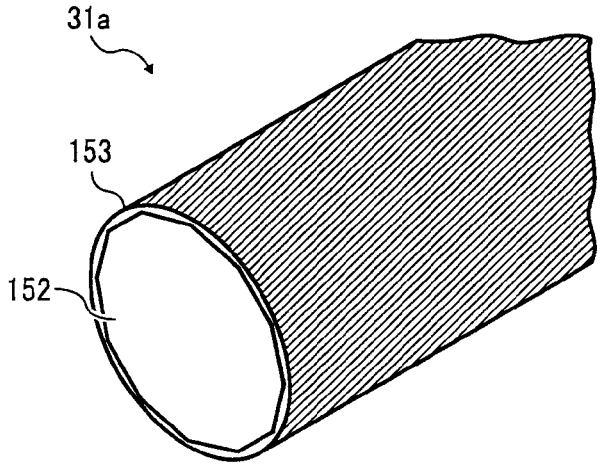
FIGS. 21A and 21B are enlarged cross-sectional diagrams of a discharge wire comprised in the charging device.
Figure 21B:
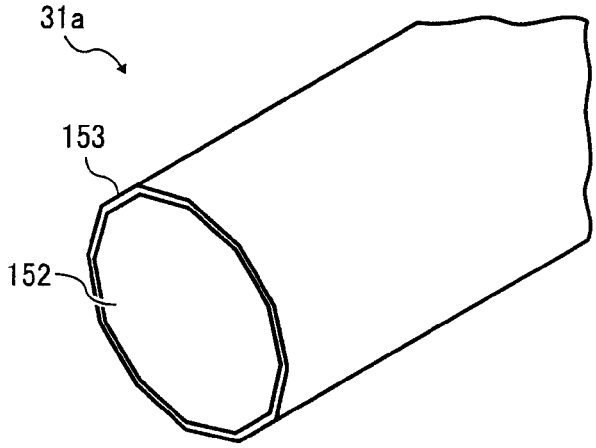

As illustrated in FIGS. 21A and 21B, the wire 31*a* comprises a thin tungsten wire 152, and a plating film 153, as a protective film, formed on the surface of the tungsten wire 152 by gold plating. FIG. 21A illustrates a plating film 153 formed on the surface of a tungsten wire 152 simply by gold plating. FIG. 21B illustrates a plating film 153 formed on the surface of a tungsten wire 152 by simple gold plating, followed next by a secondary treatment, likewise by gold plating, to yield a mirror-finished surface.

The tungsten wire 152 is used in the wire 31*a* since a smaller wire diameter enables lowering the discharge voltage. A lower initial discharge voltage is advantageous for reducing the likelihood of partial or sudden leaks, i.e. arc discharges, even when charging voltage rises over time as material goes on adhering onto the wire 31*a*.

The plating film 153 makes it harder for waste to adhere to the surface of the wire 31*a*, and favors thus preserving a good long-term condition, suitable for charging, of the wire 31*a*. Moreover, the gold plating in plating film 153 is less likely to have waste adhered thereto than, for instance, an oxide film or the like. Cleaning frequency can be reduced thereby, which allows shortening downtime periods.

However, the peripheral face of the tungsten wire 152 exhibits minute irregularities, along the longitudinal direction of the wire, that are formed during drawing of the tungsten wire 152. Therefore, when the plating film 153 is formed on the surface of the tungsten wire 152 by simple gold plating, there appear small irregularities, on the surface of the plating film 153, corresponding to the irregularities on the surface of the tungsten wire 152, as illustrated in FIG. 21A. Although such a plating film 153 exhibits considerably less waste adhesion than is the case when the tungsten wire 152 is exposed, without undergoing any gold plating, the plating film 153 is nonetheless likelier to have waste adhered thereto, on account of the small irregularities, than the plating film 153 illustrated in FIG. 21B.

Therefore, the plating film 153 is preferably finished to a mirror-surface finish, virtually devoid of irregularities, as illustrated in FIG. 21B. In the present embodiment there is used a wire 31*a* having the plating film 153. Waste is less likely to adhere to such a wire 31*a* than to the wire 31*a* illustrated in FIG. 22A.

Over time, however, some waste ends up adhering unavoidably to the wire 31*a*, whereupon the above-described cleaning is carried out by way of the discharge wire cleaning device 111. Nevertheless, the interval between cleaning operations can be made longer in the case of the wire 31*a* of FIG. 21B than in the case of that of FIG. 21A.

When using an abrasive for enhancing cleaning performance, as in the discharge wire cleaning device 111, the charging wire protective layer, i.e. the plating film 153 of the wire 31*a* in the present embodiment, is apt to be readily damaged, as described above.

The abrasive used in the discharge wire cleaning device 111 comprises an alumina component the particle size of which ranges from #6000 to #8000. Also, the thickness of the plating film 153 is no smaller than 1.5 μm, and the diameter of the tungsten wire 152 is no smaller than 30 μm.

A combination of the above conditions totally or substantially prevents the plating film 153 from being damaged by the cleaning process, while keeping small the amount of waste that becomes adhered to the plating film 153 over time.

This is made evident in the results of running tests, as given in FIGS. 22A and 22B. The running tests were carried out in a full color image forming apparatus having a constitution identical to that of the image forming apparatus 100, by running actual paper sheets, varying the thickness of the plating film 153 and the particle diameter of the abrasive. In FIG. 22A the diameter of the tungsten wire is 40 μm, while in FIG. 22B the diameter of the tungsten wire is 60 μm.

The condition to the effect of setting a diameter no smaller than 30 μm for the tungsten wire 152 derives from limitations in the production of the charging device 30 due to the strength of the tungsten wire. The running tests were thus carried out with tungsten wires having diameters of 40 μm and 60 μm, since productivity is not impaired when the diameter of the wire is 40 μm or greater.

The thickness of the plating film 153 was 1 μm, 1.5 μm and 3 μm.

The particle diameter of the abrasive is the grain size at a cumulative height of 50% (in accordance with J1S R 6002 "Testing method for bonded abrasive grain size" (electric resistance testing method).

The particle diameter of the abrasive is graded into the grain sizes #4000, #6000, #8000 according to JIS. The applicable JIS standard is, specifically, JIS R 6001 "Bonded abrasive grain sizes". A particle diameter of the abrasive in the range from #6000 to #8000 is equivalent to particle diameter ranging from 1.2 to 2.0 μm at a cumulative height of 50%.

The results of the tests are graded into ranks 1 through 5 in FIGS. 22A and 22B. To establish the ranking, halftone images were outputted, whereupon nonuniform density was visually inspected in order to judge anomalies arising from degradation of the wire 31*a*. Degradation of the wire 31*a* gives rise to nonuniform discharge, and hence to nonuniform charging on the photoconductive drum 20, which in turn is reflected as nonuniform density on the image. At a rank below 4, the life of the wire is judged to be over. That is, the wire 31*a* is judged to be in a discharge-suitable state when having a rank of 4 or higher.

As FIGS. 22A and 22B show, when the above conditions are satisfied, the problem of nonuniform density does not occur, and the wire 31*a* retains its suitability for discharge over long periods of time. That is, the results of these life tests indicate that problems such as damage and delamination of the plating film 153 do not manifest themselves when the above-described conditions are satisfied. This effect is believed to be elicited by the diameter of the abrasive particles being sufficiently smaller than the diameter of the tungsten wire 152.

As described below, the developer contains polymer toner, which favors cleanability in the photoconductive drum 20, making it possible to achieve higher-quality images. Halftone nonuniform density is likewise good, ranking at rank 4 or higher, after running 200,000 sheets, also when using such a developer.

When the particle diameter of the abrasive is smaller than #6000, i.e. when the particle diameter is larger than 2.0 μm, damage starts to appear on the plating film 153 with the passage of time, and hence device life becomes insufficiently short. On the other hand, when the particle diameter of the abrasive is larger than #8000, i.e. when the particle diameter is smaller than 1.2 μm, removability of waste is reduced.

The abrasive need not be alumina exclusively, and may comprise alumina as a main component. Instead of alumina, the abrasive may comprise silicon, exclusively or as a main component. The abrasive may also comprise, exclusively or as a main component, a mixture of alumina and silicon. The abrasive affords the same effects as described above when comprising the foregoing components.

Besides being no smaller than 1.5 μm, as described above, the thickness of the plating film 153 is preferably no greater than 3.0 μm, since costs increase dramatically when the thickness of the plating film 153 exceeds 3.0 μm. Effects identical to those described above can be achieved within that thickness range.

As described above, the diameter of the tungsten wire 152 need only be no smaller than 30 μm, but ranges preferably from 40 μm to 60 μm. When the diameter of the tungsten wire 152 is smaller than 40 μm, the strength of the wire 31*a* decreases, as described above, whereupon the wire 31*a* is likelier to break, impairing thereby the productivity of the charging device 30. By contrast, when the diameter of the tungsten wire 152 exceeds 60 μm, there increases the amount of ozone and discharge products generated during wire discharge. This requires a larger exhaust duct for disposal of these products, and by extension, a larger charging device 30 and a larger image forming apparatus 100, which entails higher costs.

When using a wire 31*a* having the above features, onto which contamination is thus less likely to adhere, and a discharge wire cleaning device 111 of high cleanability, using the above-described abrasive, there remains virtually no waste on the wire 31*a* after cleaning. Moreover, this good cleanability and the condition of the plating film 153 are both preserved over time, so that problems such as nonuniform discharge, nonuniform charging and nonuniform density do not occur as time goes by. A long-life charging device 30 is thus realized as a result.

The developer used in the image forming apparatus 100 is explained next. The developer comprises a carrier and a toner.

Preferably, the toner has a volume average particle diameter no greater than 10 μm, in particular of 3 to 8 μm, and has a ratio (Dv/Dn) of the volume average particle diameter (Dv) to a number average particle diameter (Dn) ranging from 1.00 to 1.40.

Toner can adhere compactly to the latent image when using toner having a small particle size. However, when the volume average particle diameter is smaller than the above range, the toner in the two-component developer fuses onto the surface of the magnetic carrier on account of long-term agitation in the developing device, whereupon the charging ability of the magnetic carrier is impaired. When using the toner as a one-component developer, a volume average particle diameter smaller than the above range is likely to result in toner filming over the developing roller, or in fusion of the toner onto a member such as a blade or the like that makes the toner into a thin layer. By contrast, when the volume average particle diameter is greater than the above range, it becomes difficult to achieve high-quality images with high resolution, while toner particle size often fluctuates widely when toner turnover is balanced in the developer.

Also, making the particle size distribution narrower allows achieving a uniform charge distribution in the toner, and obtaining as a result high-quality images having little background fogging, while increasing the transfer ratio. When Dv/Dn exceeds 1.40, however, the charge distribution widens and resolution decreases, which is undesirable.

The average particle diameter and particle diameter distribution of the toner can be measured using an instrument Coulter Counter TA-II or Coulter Multisizer II (by Coulter Corp.). In the present invention the average particle diameter and particle diameter distribution of the toner were measured using an apparatus comprising a Coulter Counter TA-II connected to an interface (by Nikka Instruments) that outputs a number distribution and a volume distribution, and a personal computer (PC 9801, by NEC).

The average circularity of the toner ranges preferably from 0.93 to 1.00.

Circularity is one of the parameters that characterize toner shape.

It is important for toner to have a specific shape and a specific shape distribution. When the average circularity is smaller than 0.93, the shape of toner becomes indefinite, diverging excessively from a spherical shape. This precludes achieving satisfactory transferability and obtaining flawless high-quality images.

Measurement of toner shape may be carried out on the basis of an optical detection strip method that involves causing a suspension solution, comprising toner particles, to pass through an imaging section detecting strip on a flat plate, and optically detecting and analyzing particle images using a CCD camera. The specific procedure is as follows.

The average circularity determined by this method is a value obtained by averaging, for a number of particles, a value resulting from dividing the circumference of an equivalent circle having an equal projected area, by the circumference of the actual particle, for each particle image. Toner having an average circularity thus calculated ranging from 0.90 to 1.00 is found to be effective for forming high-definition images with reproducibly appropriate density. More preferably, the average circularity ranges from 0.93 to 0.97, and particles having a circularity smaller than 0.94 are no more than 10%.

When the average circularity is smaller than 0.93 there remains little transfer residual toner when, for instance, images having a low image surface area ratio are outputted, and there occur no problems such as cleaning defects. However, cleaning defects are likelier to occur when outputting images having a high image surface area ratio, such as color photography images, and when images remain untransferred on the photoconductive drum 20 on account of, for instance, defective paper feeding.

The average circularity of toner is the value obtained by optically imaging particles, and dividing the circumference of an equivalent circle having an equal projected area, by the circumference of the actual particle, averaged over a number of particles. Specifically, average circularity is measured using a flow-type particle image analyzer (FPIA-2000 by Sysmex Corp.). Water having been purified beforehand of solid impurities is added, in an amount of 100 to 150 mL, into a predetermined container, followed by addition of 0.1 to 0.5 mL of a surfactant, as a dispersant, and addition of about 0.1 to 9.5 of measurement sample. The suspension solution having the sample dispersed therein is subjected to a dispersing treatment over about 1 to 3 minutes, in an ultrasonic disperser. The concentration of the dispersed solution is adjusted to 3,000 to 10,000 particles/μl, to measure the shape and distribution of toner particles.

The toner of the present invention has preferably a shape factor SF-1 from 100 to 180 and a shape factor SF-2 from 100 to 180.

Figure 23B:
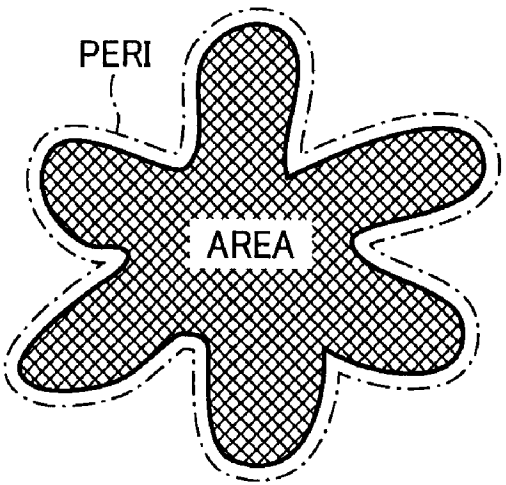
FIGS. 23A and 23B are conceptual diagrams for explaining shape factors SF-1 and SF-2, respectively, of the toner used in the image forming apparatus illustrated in FIG. 1.
Figure 23A:
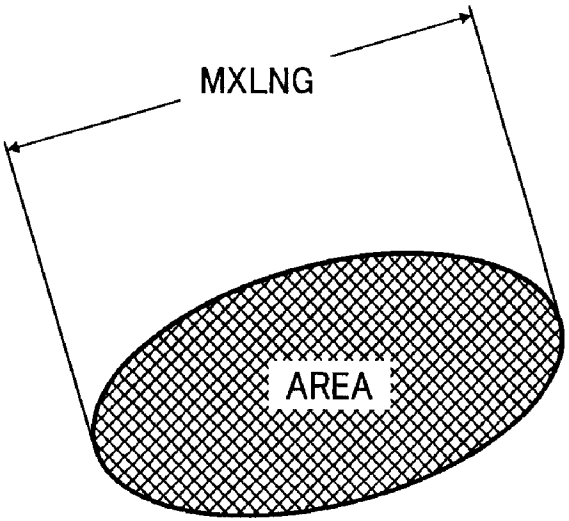

FIGS. 23A and 23B are diagrams representing schematically toner shapes, for explaining the shape factors SF-1 and SF-2.

The shape factor SF-1 is indicative of the degree of roundness of the toner shape, as expressed by Eq. (1), in which the square of the maximum length MXLNG of the toner image in a two-dimensional projection thereof is divided by the surface area, AREA, of the toner image, and then multiplied by 100 π/4.

$$SF\text{-}1=\{(MXLNG)^2/\mathrm{AREA}\}\times(100\pi/4) \quad \text{Eq. (1)}$$

When the value SF-1 is 100, the toner has a true spherical shape. The toner particles have a more indefinite shape as the value of SF-1 increases.

Meanwhile, the factor SF-2 is indicative of the degree of unevenness of the toner shape, as expressed by Eq. (2), in which the square of the length of the periphery, PERI, of the toner image in a two-dimensional projection thereof is divided by the surface area, AREA, of the image, and then multiplied by 100 π/4.

$$SF\text{-}2=\{(PERI)^2/\mathrm{AREA}\}\times(100\pi/4) \quad \text{Eq. (2)}$$

When the value SF-2 is 100, the toner surface has no irregularities. These irregularities become prominent as the value of SF-2 increases.

As the toner shape becomes more spherical, contact between toner particles or between toner and the photoconductive drum 20 becomes more of a point contact. This weakens adsorption forces between toner particles, which in turn increases toner fluidity, and weakens as well the adsorption force of toner on the photoconductive drum 20, which increases the transfer ratio. On the other hand, spherical toner intrudes readily into the gap between the cleaning blade 41 and the photoconductive drum 20, and hence the shape factor SF-1 or SF-2 should be somewhat large. When SF-1 and SF-2 become large, however, toner scatters on the image, detracting from image quality. Preferably, therefore, SF-1 and SF-2 do not exceed 180.

The shape factors are calculated, specifically, by taking photographs of the toner using a scanning electron microscope (S-800, by Hitachi Ltd.), and by analyzing the photographs in an image analyzer (LUZEX 3, by Nireco Ltd.).

The toner that can be appropriately used in the image forming apparatus 100 is, for instance, a toner obtained by performing, in an aqueous medium and in the presence of resin microparticles, a crosslinking and/or extension reaction in a toner composition that contains, at least, a polyester prepolymer having a functional group containing a nitrogen atom, a polyester, a colorant and a releasing agent. Examples of the constituent materials of the toner and manufacturing method thereof are explained next.

(Modified Polyester)

The toner comprises a modified polyester (i) as a binder resin. The modified polyester (i) denotes a polyester resin having a bonding group other than an ester bond in a polyester resin; or a polyester resin in which different resin components in the polyester are bonded through covalent bonding or ionic bonding. Specifically, the modified polyester denotes a polyester being modified by introducing a functional group such as an isocyanate group, which reacts with a carboxyl group or a hydroxyl group, at the termini of the polyester, with further reaction of the polyester with an active hydrogen-containing compound, to modify thereby the polyester termini.

Suitable modified polyester resins that can be used as the modified polyester (i) include, for instance, a urea modified polyester or the like obtained by reacting a polyester prepolymer (A) having an isocyanate group with an amine (B). As the polyester prepolymer (A) having an isocyanate group, there can be used, for example, polyesters prepared by a method in which a polyester having active hydrogen groups, being a polycondensation product of a polyhydric alcohol (PO) and a polybasic carboxylic acid (PC), is reacted with a polyfunctional isocyanate (PIC). As the active hydrogen of the polyester, hydroxyl groups (alcoholic hydroxyl groups and phenolic hydroxyl groups), amino groups, carboxyl groups, mercapto group or the like are included. Among these groups, alcoholic hydroxyl groups are preferred.

The urea modified polyester is prepared as follows.

As the polyhydric alcohol compound (PO) there can be used a dihydric alcohol (DIO) and a polyhydric alcohol (TO) higher than trihydric alcohol. A dihydric alcohol (DIO) alone or a mixture of a dihydric alcohol (DIO) with a small amount of polyhydric alcohol (TO) is preferably used. Specific examples of the dihydric alcohol (DIO) include alkylene glycols such as ethylene glycol, 1,2-propylene glycol, 1,3-propylene glycol, 1,4-butanediol, 1,6-hexanediol; alkylene ether glycols such as diethylene glycol, triethylene glycol, dipropylene glycol, polyethylene glycol, polypropylene glycol, polytetramethylene ether glycol; alicyclic diols such as 1,4-cyclohexane dimethanol, hydrogenated bisphenol A; bisphenols such as bisphenol A, bisphenol F, bisphenol S; adducts of the above-mentioned alicyclic diols with an alkylene oxide such as ethylene oxide, propylene oxide, butylenes oxide; and adducts of the above-mentioned bisphenols with an alkylene oxide such as ethylene oxide, propylene oxide, butylenes oxide or the like. Preferably used among the foregoing are alkylene oxide adducts of bisphenols and C2-C12 alkylene glycols, in particular alkylene oxide adducts of bisphenols, used concomitantly with C2-C12 alkylene glycols. Specific examples of the tri- or more polyhydric alcohol (TO) include, for instance, polyhydric aliphatic alcohols having 3 to 8 hydroxyl groups, such as glycerin, trimethylolpropane, trimethylolethane, pentaerythritol and sorbitol; phenol compounds having 3 or more hydroxyl groups such as trisphenol PA, phenol novolac and cresol novolac; and alkylene oxide adducts of the abovementioned phenol compounds having 3 or more hydroxyl groups.

The polybasic carboxylic acid (PC) may be a dicarboxylic acid (DIC), or a tri- or more polybasic carboxylic acid (TC). The use of a dicarboxylic acid (DIC) singly, or a mixture of a dicarboxylic acid (DIC) with a small amount of a tri- or more polybasic carboxylic acid (TC), is preferred. Examples of the dicarboxylic acid (DIC) include, for instance, alkyldicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid, and naphthalene dicarboxylic acid. Preferred among the foregoing are C4-C20 alkenylene dicarboxylic acids and C8-C20 aromatic dicarboxylic acids. Preferred examples of the tri- or more polybasic carboxylic acid (TC) include C9-C20 aromatic polybasic carboxylic acids (PC) such as trimellitic acid and pyromellitic acid. The polybasic carboxylic acids (PC) may be formed by reacting the above-described anhydrides or lower alkyl esters, such as methyl ester, ethyl ester and isopropyl ester, with the polyhydric alcohol (PO).

The ratio of polyhydric alcohol (PO) and polybasic carboxylic acid (PC), expressed as the ratio [OH]/[COOH] of the equivalents of hydroxyl groups [OH] to the equivalents carboxyl groups [COOH], ranges ordinarily from 2/1 to 1/1, preferably from 1.5/1 to 1/1, and more preferably from 1.3/1 to 1.02/1.

Examples of the polyfunctional isocyanate compound (PIC) include, for instance, aliphatic polyfunctional isocyanates such as tetramethylene diisocyanate, hexamethylene diisocyanate and 2,6-diisocyanate methylcaproate; alicyclic polyfunctional isocyanates such as isophorone diisocyanate, cyclohexylmethane diisocyanate; aromatic diisocyanates such as tolylene diisocyanate, diphenylmethane diisocyanate; araliphatic diisocyanates such as α, α, α', α'-tetramethylxylylene diisocyanate; isocyanurates; the abovementioned polyfunctional isocyanates blocked with phenol derivatives, oximes or caprolactams; and mixtures of two or more of the foregoing.

The ratio of the polyfunctional isocyanate compounds (PIC), which is represented by the ratio [NCO]/[OH] of the equivalents of isocyanate groups [NCO] to the equivalents hydroxyl groups [OH] of the polyester, ranges ordinarily from 5/1 to 1/1, preferably from 4/1 to 1.2/1, more preferably from 2.5/1 to 1.5/1. A [NCO]/[OH] ratio exceeding 5/1 tends to adversely affect low temperature fixability. A molar ratio of [NCO] smaller than 1 tends to reduce the urea content in the ester when urea-modified polyester is used, and to adversely affect anti-hot offset properties.

The content of the polyfunctional isocyanate compound (PIC), as a constituent component of the isocyanate group-containing polyester prepolymer (A), ranges ordinarily from 0.5 to 40 wt %, preferably from 1 to 30 wt %, more preferably from 2 to 20 wt % relative to the isocyanate group-containing polyester prepolymer (A). A polyfunctional isocyanate compound content of less than 0.5% tends to adversely affect anti-hot offset properties and to preclude achieving simultaneously both low temperature fixabilty and heat-resisting storability. A polyfunctional isocyanate compound content beyond 40 wt % impairs low-temperature fixability.

The average number of isocyanate groups per molecule of the isocyanate group-containing polyester prepolymer (A) is ordinarily no smaller than 1, preferably 1.5 to 3, more preferably 1.8 to 2.5. Less than 1 isocyanate group per molecule results in a urea-modified polyester having a small molecular weight, which impairs the anti-hot offset properties of the toner.

Examples of the amine (B) that is reacted with the polyester prepolymer (A) include, for instance, diamines (B1) polyfunctional amines (B2) having three or more amino groups, amino alcohols (B3), amino mercaptans (B4), amino acids (B5), and amines (B6) in which the amino groups of (B1) through (B5) are blocked.

Specific examples of suitable diamines (B1) include aromatic diamines such as phenylenediamine, diethyltoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Examples of suitable polyfunctional amines (B2) having 3 or more amino groups include, for instance, diethylenetriamine and triethylenetetramine. Examples of suitable amino alcohols (B3) are ethanolamine and hydroxyethylaniline. Examples of suitable amino mercaptans (B4) include, for instance, aminoethylmercaptan and aminopropylmercaptan. Examples of suitable amino acids (B5) include, for instance, aminopropionic acid and aminocaproic acid. Suitable examples of the amines (B6) in which the amino groups of (B1) through (B5) are blocked include, for instance, ketimine compounds formed by reacting the (B1) to (B5) amines with ketones such as acetone, methyl ethyl ketone and methyl isobutyl ketone, or oxazolidine compounds. Particularly preferred among the amines (B) are diamines (B1) either individually or in combination with a small amount of polyfunctional amines (B2).

The ratio of amines (B) relative to the isocyanate group-containing polyester prepolymer (A), which is represented by [NCO]/[NHx] of the equivalents of isocyanate groups [NCO] to the equivalents of amino groups [NHx] of the amine (B), ranges ordinarily from 1/2 to 2/1, preferably from 1.5/1 to 1/1.5, more preferably from 1.2/1 to 1/1.2. An [NCO]/[NHx] ratio above 2/1 or below 1/2 results in a lower molecular weight of the urea-modified polyester, which impairs the anti-hot offset properties of the toner.

The urea-modified polyester may contain urethane bonds as well as urea bonds. The molar ratio of urea bond content to urethane bond content ranges ordinarily from 100/0 to 10/90, preferably from 80/20 to 20/80, more preferably from 60/40 to 30/70. A molar ratio of urea bonds below 10% impairs the anti-hot offset properties of toner.

The modified polyester (i) used in the present invention may be prepared by a one-shot method. The weight-average molecular weight of the modified polyester (i) is ordinarily no smaller than 10,000, and ranges preferably from 20,000 to 10,000,000, more preferably from 30,000 to 1,000,000. The peak molecular weight ranges preferably from 1,000 to 10,000. A peak molecular weight below 1,000 hampers the extension reaction and reduces toner flexibility, impairing as a result the anti-hot offset properties of the toner. A peak molecular weight beyond 10,000 reduces fixability and exacerbates manufacturing problems during particle formation and crushing. When the modified polyester (i) is used in combination with a below-described non-modified polyester (ii), the number average molecular weight of the modified polyester (i) is not particularly limited, and may be a number-average molecular weight that allows easily achieving the above-described weight-average molecular weight. When the modified polyester (i) is used singly, the number-average molecular weight thereof is ordinarily no greater than 20,000, and ranges preferably from 1,000 to 10,000, more preferably 2,000 to 8,000. When the number-average molecular weight of the modified polyester exceeds 20,000, low-temperature fixability deteriorates, and glossiness is impaired when the toner is used in a full color apparatus.

In the cross-linking reaction and/or elongation reaction of the polyester prepolymer (A) with the amine (B) to prepare the modified polyester (i), a reaction stopper can be used, as the case may require, to adjust the molecular weight of the resulting urea-modified polyester. Specific examples of such reaction stoppers include, for instance, monoamines (e.g., diethyl amine, dibutyl amine, butyl amine and lauryl amine); and blocked amines (ketimine compounds) obtained by blocking the foregoing monoamines.

The molecular weight of the polymer to be formed can be measured by means of gel permeation chromatography (GPC), using THF as a solvent.

(Unmodified Polyester)

The toner in the present invention can contain not only the above-described polyester (i), but also an unmodified polyester (ii), in combination with the polyester (i), as a binder resin component. By using a combination of modified polyester (i) with an unmodified polyester (ii), the low-temperature fixability of the toner can be improved, while glossiness can be improved as well when the toner is used in a full color apparatus. This concomitant use is thus preferable to using of the polyester (i) alone. Suitable unmodified polyesters (ii) include polycondensation products of a polyhydric alcohol (PO) with a polybasic carboxylic acid (PC) identical to the polyester components of the above-described polyester (i). Preferred examples of the polyhydric alcohol (PO) and a polybasic carboxylic acid (PC) are also identical to those of the polyester (i). Also, the polyester (ii) may be not only an unmodified polyester, but also a polyester modified with chemical bonds other than urea bonds, for instance a polyester modified with urethane bonds. When using a mixture of a modified polyester (i) with an unmodified polyester (ii), it is preferable that the foregoing be at least partially compatible, from the viewpoint of low-temperature fixability and hot offset resistance of the resulting toner. Accordingly, the polyester component (i) and (ii) have preferably a similar composition. When the modified polyester (i) contains an unmodified polyester (ii), the weight ratio of polyester (i) to (ii) when (ii) is present ranges ordinarily from 5/95 to 80/20, preferably from 5/95 to 30/70, more preferably from 5/95 to 25/75, and yet more preferably from 7/93 to 20/80. A weight ratio of polyester (i) of less than 5% tends to adversely affect anti-hot offset properties and to preclude achieving simultaneously both low temperature fixability and heat-resisting storability.

The peak molecular weight of the unmodified polyester (ii) ranges ordinarily from 1,000 to 10,000, preferably from 2,000 to 8,000, and more preferably from 2,000 to 5,000. When the peak molecular weight is below 1,000, the heat-resisting storability of the toner deteriorates, while low-temperature fixability becomes impaired when the peak molecular weight exceeds 10,000. Preferably, the hydroxyl value of the unmodified polyester (ii) is not lower than 5, and ranges preferably from 10 to 120, and in particular, from 20 to 80. A hydroxyl value below 5 tends to preclude achieving simultaneously low temperature fixability and heat-resisting storability. The acid value of the unmodified polyester (ii) ranges preferably from 1 to 5, more preferably from 2 to 4. When a wax having a high acid value is used as the wax, a low acid-acid value binder is used to impart chargeability and high volume resistivity, to better match toners that are used in two-component developers.

The glass transition temperature (Tg) of the binder resin ranges ordinarily from 35 to 70° C., preferably from 55 to 65° C. When the glass transition temperature is below 35° C., heat-resisting storability is impaired, while low-temperature fixability is insufficient when the glass transition temperature exceeds 70° C. The urea-modified polyester appears readily on the surface of the obtained toner mother particles, and hence the toner of the present invention exhibits good heat-resisting storability, even with a low glass transition temperature, as compared with known polyester-based toners.

The glass transition temperature (Tg) can be measured by differential scanning calorimetry (DSC).

(Colorant)

Any of pigments and dyes conventionally known can be employed as the colorant. The colorant may be, for example, carbon black, a Nigrosine dye, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthracene Yellow BGL, isoindolinone yellow, red iron oxide, red lead, orange lead, cadmium red, cadmium mercury red, antimony orange, Permanent Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4R), Fast Scarlet VD, Vulkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perinone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide or lithopone. The content of colorant ranges ordinarily from 1 to 15 wt %, more preferably from 3 to 10 wt % of the toner.

The colorant can also be used in the form of a master batch, combined with a resin. Examples of resins used for master batch preparation, or that are kneaded with master batches include, for instance, styrene polymers and substituted styrene polymers such as polystyrene, poly-p-chlorostyrene and polyvinyltoluene; copolymers of the foregoing with vinyl compounds; as well as polymethyl methacrylate, polybutyl methacrylate, polyvinyl chloride, polyvinyl acetate, polyethylene, polypropylene, polyesters, epoxy resins, epoxy polyol resins, polyurethane, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes or the like. These resins are used alone or in combination.

(Charge Control Agent)

Examples of the charge control agent that can be used include, for instance, known charge control agents such as Nigrosine dyes, triphenylmethane dyes, chromium-containing metal complex dyes, chelate pigments of molybdic acid, rhodamine dyes, alkoxyamines, quaternary ammonium salts (including fluorine-modified quaternary ammonium salts), alkylamides, phosphor or phosphor compounds, tungsten or tungsten compounds, fluorine-containing activators, metal salts of salicylic acid, and metal salts of salicylic acid derivatives or the like. Specific examples of the foregoing include, for instance, BONTRON® 03 (Nigrosine dye), BONTRON® P-51 (quaternary ammonium salt), BONTRON® S-34 (metal-containing azo dye), E-82 (metal complex of oxynaphthoic acid) E-84 (metal complex of salicylic acid), and E-89 (phenolic condensation product), by Orient Chemical Industries Co., Ltd.; TP-302 and TP-415 (molybdenum complex of quaternary ammonium salt), by Hodogaya Chemical Co., Ltd.; COPY CHARGE® PSY VP2038 (quaternary ammonium salt), COPY BLUE® (triphenyl methane derivative), COPY CHARGE® NEG VP2036 and NX VP434 (quaternary ammonium salt), by Hoechst AG; LRA-901, and LR-147 (boron complex), by Japan Carlit Co., Ltd.; as well as copper phthalocyanine, perylene, quinacridone, azo pigments and polymeric compounds having a functional group such as a sulfonate group, a carboxyl group, a quaternary ammonium group or the like. Among these there are preferably used, in particular, charge control agents that can control negative charge in the toner.

The content of the charge control agent, which is not particularly limited, is determined depending on the kind of binder resin used, on whether or not an additive is added, and on the toner manufacturing method (such as dispersion). However, the content of the charge control agent ranges ordinarily from 0.1 to 10 parts by weight, and preferably from 0.2 to 5 parts by weight, relative to 100 parts by weight of the binder resin. When the content of charge control agent exceeds 10 parts by weight, the chargeability of the toner becomes excessive and the effect of the charge control agent is weakened. The electrostatic attraction force of the developing roller increases as a result, which reduces developer fluidity and image density.

(Release Agent)

Suitable release agents include waxes having a melting point of from 50 to 120° C. The wax, which is dispersed in the binder resin, acts as an effective release agent between the fixing roller and the toner interfacial surface. Hot offset resistance can be improved thereby without applying a release agent such as oil or the like to the fixing roller. Examples of waxes that can be used may be a natural wax including vegetable waxes, such as carnauba wax, cotton wax, Japan wax and rice wax; animal waxes, such as bees wax and lanolin; mineral waxes, such as ozokerite and ceresine; and petroleum waxes, such as paraffin waxes, microcrystalline waxes and petrolatum. In addition, synthetic waxes can also be used. Specific examples of the synthetic waxes include synthetic hydrocarbon waxes such as Fischer-Tropsch waxes and polyethylene waxes; and synthetic waxes such as ester waxes, ketone waxes and ether waxes. Further examples include fatty acid amides such as 1,2-hydroxy stearic acid amide, stearic acid amide and phthalic anhydride imide; and low molecular weight crystalline polymers such as acrylic homopolymers and copolymers having a long alkyl group in their side chain, such as poly-n-stearyl methacrylate, poly-n-laurylmethacrylate and n-stearyl acrylate-ethyl methacrylate copolymers.

The charge control agent and the release agent can be kneaded with a master batch and a binder resin. Needless to say, the charge control agent and the release agent can be dissolved or dispersed in an organic solvent.

(External Additive)

Inorganic microparticles are preferably used as the external additive for assisting in improving the fluidity and developing properties and chargeability of the toner particles. Preferably, the inorganic microparticles have a primary particle diameter of $5\times10^{-3}$ to 2 μm, and more preferably from $5\times10^{-3}$ to 0.5 μm. In addition, the specific surface area of such inorganic microparticles ranges preferably from 20 to 500 $m^2/g$, as measured by BET. The content of inorganic microparticles in the toner ranges preferably from 0.01 to 5 wt %, and more preferably from 0.01 to 2.0 wt % relative to the toner.

Specific examples of such inorganic microparticles include, for instance, silica, alumina, titanium oxide, barium titanate, magnesium titanate, calcium titanate, strontium titanate, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride or the like. Among the foregoing, a combination of hydrophobic silica microparticles and hydrophobic titanium oxide microparticles is preferably used as a fluidity-imparting agent. In particular, the electrostatic forces and van der Waals' forces between the external additive and the toner are improved dramatically when using hydrophobic silica and hydrophobic titanium microparticles that have an average particle diameter no greater than $5\times10^{-2}$ μm. As a result, the fluidity-imparting agent does not separate from the toner even when the toner is stirred and mixed in the developing device for obtaining a desired charge level. Good image quality can be achieved thereby, without white spots or the like, while the amount of transfer residual toner can be likewise reduced.

When titanium oxide microparticles are used as the external additive, the resulting toner can stably yield toner images having excellent image density and environmental stability. As a secondary effect, however, the charge rising properties of the toner tend to deteriorate when the addition amount of the titanium oxide microparticles is greater than that of the silica microparticles. Charge rising properties, however, do not become impaired when the addition amount of hydrophobic silica microparticles and hydrophobic titanium oxide microparticles lies within a range from 0.3 to 1.5 wt %. Within that range, thus, desired charge rising properties can be obtained. That is, stable image quality can be achieved even after repeated copying.

A preferred toner manufacturing method is explained next, although the manufacturing method is not limited thereto.

(Toner Manufacturing Method)

1) Firstly, a toner material solution is prepared by dispersing a colorant, an unmodified polyester resin, a polyester prepolymer having isocyanate groups and a release agent, in an organic solvent.

Preferred organic solvents include volatile organic solvents having a boiling point below 100° C. so that the solvent can be easily removed after formation of toner mother particles. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, or the like, singly or in combination. In particular, aromatic solvents such as toluene and xylene, and halogenated hydrocarbons such as methylene chloride, 1,2-dichloroethane, chloroform and carbon tetrachloride are preferably used. The quantity of organic solvent ranges ordinarily from 0 to 300 parts by weight, preferably from 0 to 100 parts by weight and more preferably from 25 to 70 parts by weight relative to 100 parts by weight of the polyester prepolymer.

2) The toner material solution is emulsified in an aqueous medium in the presence of a surfactant and/or resin microparticles. Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone).

The amount of aqueous medium ranges ordinarily from 50 to 2000 parts by weight, preferably from 100 to 1000 parts by weight, relative to 100 parts by weight of toner material solution. When the amount of aqueous medium is less than 50 parts by weight, the toner material solution disperses poorly, and toner particles having a predetermined particle diameter fail to be obtained. On the other hand, a content of aqueous medium in excess of 2,000 parts by weight is uneconomical.

A dispersant such as a surfactant, resin microparticles or the like can be appropriately added to improve the dispersion of the toner material solution in the aqueous medium.

Examples of surfactants include, for instance, anionic surfactants such as alkylbenzene sulfonates, α-olefin sulfonic acid salts, and phosphate esters; cationic surfactants such as amine salts (e.g., alkylamine salt, amino alcohol fatty acid derivatives, polyfunctional amine fatty acid derivatives, or imidazoline), and quaternary ammonium salts (e.g. alkyltrimethyl ammonium salts, dialkyldimethyl ammonium salts, alkyldimethyl benzyl ammonium salts, pyridinium salts, alkyl isoquinolinium salts or benzethonium chloride); nonionic surfactants such as fatty acid amide derivatives, polyhydric alcohol derivatives or the like; and ampholytic surfactants such as alanine, dodecyldi(aminoethyl)glycine, di(octylaminoethyle)glycine, or N-alkyl-N,N-dimethylammonium betaine.

The effect of the surfactant can be brought out with very small addition amounts when using surfactants having fluoroalkyl groups. Preferred examples of anionic surfactants having fluoroalkyl groups include, for instance, fluoroalkyl carboxylic acids having from 2 to 10 carbon atoms, and metal salts thereof, disodium perfluorooctanesulfonylglutamate, sodium 3-[omega-fluoroalkyl(C6-C11)oxy]-1-alkyl(C3-C4) sulfonate, sodium 3-[omega-fluoroalkanoyl(C6-C8)-N-ethylamino]-1-propanesulfonate, fluoroalkyl (C11-C20)carboxylic acids and metal salts thereof, perfluoroalkylcarboxylic acids (C7-C13) and metal salts thereof, perfluoroalkyl(C4-C12)sulfonate and metal salts thereof, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates or the like.

Examples of commercial products of such surfactants having fluoroalkyl groups include, for instance, SURFLON® S-111, S-112 and S-113, by Asahi Glass Co., Ltd.; FRORARD® FC-93, FC-95, FC-98 and FC-129, by Sumitomo 3M Ltd.; UNIDYNE® DS-101 and DS-102, by Daikin Industries, Ltd.; MEGAFACE® F-110, F-120, F-113, F-191, F-812 and F-833 by Dainippon Ink and Chemicals, Inc.; ECTOP® EF-102, 103, 104, 105, 112, 123A, 306A, 501, 201 and 204, by Tohchem Products Co., Ltd.; FUTARGENT® F-100 and F150 by Neos.

Examples of cationic surfactants include, for instance, primary, secondary and tertiary aliphatic amino acids, aliphatic quaternary ammonium salts (such as perfluoroalkyl(C6-C10) sulfoneamidepropyltrimethylammonium salts), benzalkonium salts, benzethonium chloride, pyridinium salts, imidazolinium salts or the like. Specific examples of commercial products thereof include SURFLON® S-121 (by Asahi Glass Co., Ltd.); FRORARD® FC-135 (by Sumitomo 3M Ltd.); UNIDYNE® DS-202 (by Daikin Industries, Ltd.); MEGAFACE® F-150 and F-824 (by Dainippon Ink and Chemicals, Inc.); ECTOP® EF-132 (by Tohchem Products Co., Ltd.); FUTARGENT® F-300 (by Neos) or the like.

Resin microparticles can be added to stabilize the toner mother particles formed in the aqueous medium. To that end, the resin microparticles are preferably added so as to cover the surface of the mother toner particles to a covering ratio from 10 to 90%. Examples of the resin microparticles include, for instance, polymethylmethacrylate microparticles of 1 μm and 3 μm, polystyrene microparticles of 0.5 μm and 2 μm, polystyrene-acrylonitrile copolymer microparticles having a particle diameter of 1 μm or the like, as well as commercial products such as PB-200H (by Kao Corp.), SGP (by Soken Chemical & Engineering Co., Ltd.), TECHNOPOLYMER® SB (by Sekisui Plastics Co., Ltd.), SPG-3G (by Soken Chemical & Engineering Co., Ltd.), MICROPEARL® (by Sekisui Fine Chemical Co., Ltd.) or the like.

An inorganic compound dispersant can also be used, for instance, tricalcium phosphate, calcium carbonate, titanium oxide, colloidal silica, hydroxyapatite or the like.

Dispersion droplets may also be stabilized by using a polymeric protective colloid as a dispersant employed concomitantly with the above-described resin microparticles and/or inorganic compound dispersants. Examples of polymeric protective colloids include, for instance, polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), (metha)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide and N-methylolmethacrylamide), vinyl alcohol and ethers thereof (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and methylol compounds thereof, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine), as well as polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose.

The dispersion method is not particularly limited. Herein there can be used known dispersion equipment for low speed shearing dispersion, high speed shearing dispersion, friction dispersion, high pressure jet dispersion, ultrasonic dispersion or the like. Among the foregoing, high-speed shearing dispersion is preferred for adhering dispersion particles having a diameter of 2 μm to 20 μm. The revolutions of the high-speed shearing disperser are not particularly limited, but range ordinarily from 1,000 to 30,000 rpm, more preferably from 5,000 to 20,000 rpm. The dispersion time is not particularly limited, and ranges ordinarily from 0.1 to 5 minutes in batch operations. The temperature during the dispersion process ranges ordinarily from 0 to 150° C. (under pressure), preferably from 40 to 98° C.

3) Simultaneously with the emulsifying operation, the amine (B) is added and reacted with the polyester prepolymer (A) having isocyanate groups.

This reaction accompanies crosslinking and/or extension of the molecular chains of the polyester prepolymer (A). The reaction time is determined depending on the reactivity of the amine (B) with the isocyanate group structure of the polyester prepolymer (A), but ranges typically from 10 minutes to 40 hours, preferably from 2 to 24 hours. The reaction temperature ranges ordinarily from 0 to 150° C., preferably from 40 to 98° C. Known catalysts may also be used, as the case may require, for instance dibutyltin laurate, dioctyltin laurate or the like.

4) After the reaction, the organic solvent is removed from the emulsified dispersion (reaction product), followed by washing and drying, to yield toner mother particles.

To remove the organic solvent, the temperature of the entire system is gradually raised under laminar-flow agitation. At a certain temperature range, the system is then agitated vigorously, followed by solvent removal, to prepare spindle-like toner mother particles. When using compounds such as calcium phosphate, which are soluble in acids and alkalis, as a dispersion stabilizer, it is preferable to dissolve the compound by adding an acid such as hydrochloric acid, followed by washing of the toner mother particles with water, to remove calcium phosphate therefrom. In addition, calcium phosphate can be removed using a zymolytic method.

5) The charge control agent is then fixed into the toner mother particles thus obtained, followed by addition of inorganic microparticles such as silica microparticles, titanium oxide microparticles or the like, to yield a toner.

Fixation of the charge control agent and addition of the inorganic microparticles can be carried out in accordance with known methods using, for instance, a mixer or the like.

The above method allows obtaining easily toner having a small particle diameter and a narrow particle diameter distribution. Also, vigorous agitation during removal of the organic solvent allows controlling the shape of the toner to range between a perfect sphere and a rugby-ball shape, and allows controlling surface morphology of the toner to range between a smooth and craggy surface.

The shape of the toner, which is substantially spherical, can be represented in accordance with the following shape specifications.

Figure 24A:
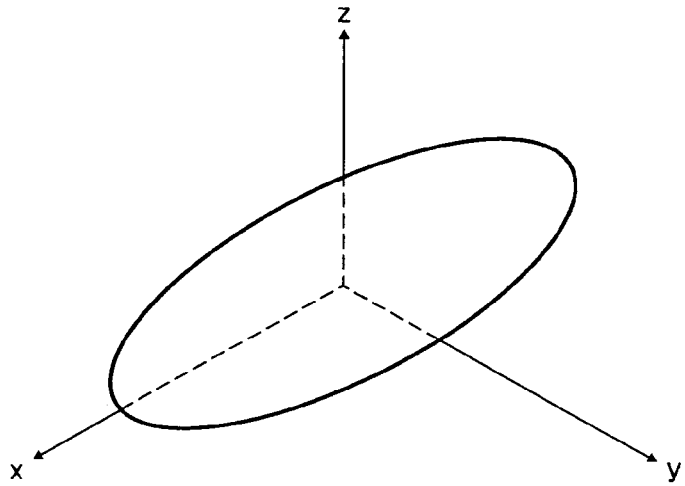
FIGS. 24A to 24C are conceptual diagrams for explaining the mutual relationship between major axis, short axis and thickness, respectively, in the toner used in the image forming apparatus.
Figure 24B:
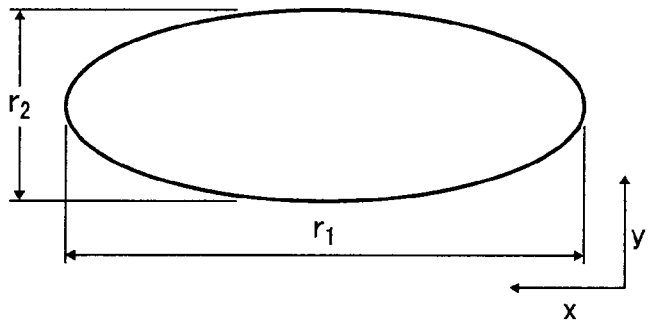
Figure 24C:
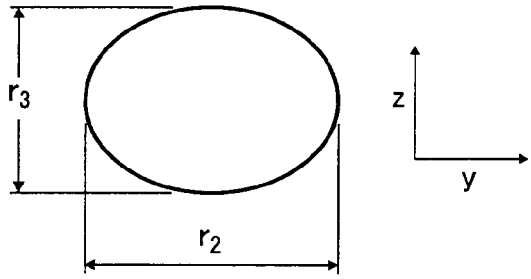

FIGS. 24A to 24C are diagrams that illustrate schematically toner shape. In FIGS. 24A to 24C, the substantially spherical toner shape is defined by a major axis r1, a minor axis r2 and a thickness r3 (such that r1≧r2≧r3) wherein, preferably, the ratio (r2/r1) of the major axis to the minor axis (FIG. 24B) ranges from 0.5 to 1.0, and the ratio (r3/r2) of the thickness to the minor axis (FIG. 24C) ranges from 0.7 to 1.0. When the ratio (r2/r1) of the major axis to the minor axis is smaller than 0.5, the toner shape diverges from a perfect sphere. This impairs dot reproducibility and transfer efficiency, and precludes achieving high-quality images. On the other hand, when the ratio (r3/r2) of the thickness to the minor axis is smaller than 0.7, the toner shape becomes flatter, which precludes achieving high transfer efficiency, as is the case with spherical toner. Toner fluidity can be enhanced, in particular, when the ratio (r3/r2) of the thickness to the minor axis is 1.0, in which case the toner particle becomes a rotating body.

The magnitudes of r1, r2, r3 can be measured by observing micrographs of toner particles, obtained at various angles, using a scanning electron microscope (SEM).

The toner manufactured as described above can be used as a one-component magnetic toner, which employs no magnetic carrier, or as a non-magnetic toner.

When the toner is used in a two-component developer, the toner may be mixed with a magnetic carrier. Specific examples of the magnetic carrier include, for instance, ferrites comprising a divalent metal such as iron, magnetite, Mn, Zn, Cu or the like, having a volume average particle diameter ranging preferably from 20 to 100 μm. When the average particle diameter is smaller than 20 μm, the carrier is likely to adhere to the photoconductive drum 20 during developing. When the average particle diameter exceeds 100 μm, the carrier tends to mix poorly with the toner, whereby the latter fails to charge sufficiently. This results in, for instance, defective charging upon continuous toner use. Although copper ferrite comprising Zn is preferred on account of its high saturation magnetization, the magnetic carrier can be appropriately selected in accordance with the process of the image forming apparatus 100. The resin used for coating the magnetic carrier is not particularly limited. Examples thereof include, for instance, silicone resins, styrene-acrylic resins, fluororesins and olefin resins. The resin can be manufactured by dissolving a coating resin in a solvent, and spraying the solution in a fluidized bed, to coat a core material with the resin, or by electrostatically adhering resin particles to core particles, followed by thermal fusion to coat the core particles with the resin. The thickness of the resin coating ranges from 0.05 to 10 μm, preferably from 0.3 to 4 μm.

During document copying in the image forming apparatus 100 having the above constitution, the document is set on the automatic document feeder 22, or is placed on the contact glass 21*a*, as described above. Then the start button of the operation panel is pressed. When the image forming apparatus 100 is used as a printer, image data for image formation is selected and inputted via an external input device such as a PC or the like, connected to the image forming apparatus 100, whereupon image formation is initiated.

When copying documents, the document is set on the automatic document feeder 22, whereupon the set document is fed onto the contact glass 21*a*, and is read then by the reading device 21. When the document is placed on the contact glass 21*a*, the reading device 21 reads the document, to generate image data, upon pressing of the start button.

For reading of the document, the first traveling body 21*ba* and the second traveling body 21*c* move while light from the light source is irradiated towards the document. The light reflected by the surface of the document is reflected by the first reflective member towards the second traveling body 21*c*. The light is reflected by the second reflective member, which changes the direction of the light by 180 degrees. The light passes then through the image forming lens 21*d* and strikes the reading sensor 21*e*, which reads the content of the document.

The image stations 60Y, 60M, 60C, 60BK having the above-described constitution come into operation on the basis of the generated image data or on the basis of inputted image data.

In the image station 60Y, the photoconductive drum 20Y rotates in the B1 direction, whereupon the surface of the photoconductive drum 20Y is uniformly charged by the charging device 30Y. This charging process can be carried out satisfactorily with the passage of time since, as described above, the wire 31*a*Y is kept in a good condition over time.

An electrostatic latent image corresponding to yellow color is formed then on the photoconductive drum 20Y, through exposure of scanning of laser light L by the optical scanning device 8. The electrostatic latent image is developed with yellow toner by the developing device 50Y, and the yellow toner image thus developed is primary-transferred onto the intermediate transfer belt 11, which moves in the A1 direction, by the primary transfer roller 12Y. Waste containing residual toner after transfer is removed by the cleaning device 40Y, and then the next charge removal and charging operations are carried out by the charge removing device 61Y and the charging roller 31Y.

Toner images of other colors are formed in the same way on the other photoconductive drums 20C, 20M, 20BK. The toner images of respective colors thus formed are sequentially primary-transferred, by the primary transfer rollers 12C, 12M, 12BK, onto a same position of the intermediate transfer belt 11, moving in the A1 direction, to form on the intermediate transfer belt 11 a full-color composite color image. Accompanying the rotation of the intermediate transfer belt 11 in the A1 direction, the superposed toner image on the intermediate transfer belt 11 is transported up to a secondary transfer nip, being a contact pressure portion at a position where the secondary transfer roller 17 and the transfer entrance roller 73 oppose each other, and where secondary transfer of the toner image onto a sheet takes place.

The sheet transported up to the position between the intermediate transfer belt 11 and the secondary transfer roller 17 is a sheet fed out of a corresponding paper feeding cassette 25, through rotation of one selected feeding roller of the feeding rollers 24 of the sheet feeding device 23, or a sheet fed out of the manual tray 34, through rotation of the feeding roller 35 of the manual paper feeding device 33, or a sheet paid out from the double-sided unit 96 by the paper feeding roller 95. Sheet transport is temporarily discontinued by the resist roller 13, whereafter transport and feeding of the sheet is reinitiated, in accordance with a measured timing with which the leading end of the toner image on the intermediate transfer belt 11 reaches the secondary transfer roller 17, on the basis of detection signals by a sensor.

When all the toner images of all colors are transferred onto the sheet, the latter is transported by the transport device 76 and introduced into the fixing device 6. When the sheet carrying the toner image passes through the fixing portion between the fixing belt 64 and the pressing roller 63, the toner image carried on the sheet is fixed through the action of heat and pressure, to form thereby a color image on the sheet. Depending on the orientation of the switching claw 94, the fixed sheet fixed having passed thus through the fixing device 6 is stacked onto the paper output tray 75, via the paper output rollers 98, or is introduced into the double-sided unit 96, via the transfer rollers 97, for double-sided image formation. Meanwhile, the intermediate transfer belt cleaning device 14 cleans the intermediate transfer belt 11, after completion of secondary transfer, by removing residual toner and so forth remaining on the intermediate transfer belt 11, in preparation for the next image formation.

The specific preferred embodiments of the present invention explained thus far are not meant to limit in any way the invention, which is not particularly restricted to the above explanation. Various modifications and variations are possible without departing from the scope of the present invention as set forth in the claims.

For instance, the charge removal step may be carried out after the cleaning step, and before the charging step. Primary transfer and secondary transfer may be carried out using a wire-type transfer device, such as the above-described charging device. The charge removing device may be provided after secondary transfer, and the charge removing device may be of wire type, as the above-described charging device.

Besides so-called tandem-type image forming apparatuses, the present invention can be used as well in so-called one-drum type image forming apparatuses, in which toner images of respective colors are sequentially formed on one photoconductive drum to yield a color image through superposition of toner images of respective colors.

In both types of image forming apparatus there may also be employed direct transfer, in which toner images of respective colors are directly transferred to a sheet or the like, without an intervening intermediate transfer member. In this case the toner images on plural image carriers are directly transferred to the sheet. The image forming apparatus may also be an image forming apparatus capable of forming only monochrome images. In these cases, the constitution of the image forming apparatus is such that a transfer belt 11 can be equivalent to the sheet in the explanation above (refer to FIG. 2).

Besides a multifunction machine comprising a copier, a printer and a fax machine, the image forming apparatus may be any of the foregoing standing alone, or a multifunction machine comprising other combinations, such as a multifunction machine combining a copier and a printer.

The effects afforded by the present invention are set forth below.

(1) The present invention is a charging device comprising a discharge wire for charging an image carrier, and a cleaning member for cleaning the discharge wire, wherein the cleaning member has an abrasive comprising alumina and/or silicon, the grain size of the abrasive ranges from #6000 to #8000, the discharge wire is a tungsten wire on which a plating film is formed by gold plating, the thickness of the plating film is no smaller than 1.5 μm, and the diameter of the tungsten wire is no smaller than 30 μm. As a result, the plating film can be preserved in good condition over time, and the discharge wire can be maintained in a state that facilitates cleaning, as contamination adheres less readily onto the discharge wire. A long-life charging device can thus be provided enabling good charging of an image carrier as well as good image formation.

(2) When the thickness of the plating film is no greater than 3 μm, the cost of the plating film can be controlled, the latter can be preserved in good condition over time, and the discharge wire can be maintained in a state that facilitates cleaning, as contamination adheres less readily onto the discharge wire. A long-life charging device can thus be provided enabling good charging of an image carrier and contributing to good image formation.

(3) When the diameter of the tungsten wire ranges from 40 μm to 60 μm, the strength of the tungsten wire can be secured and breakage of the tungsten wire can be prevented or controlled, the ozone and discharge products generated during discharge can be controlled, and the means for treating these discharge products can be simplified. The plating film can be preserved in good condition over time, and the discharge wire can be maintained in a state that facilitates cleaning, as contamination adheres less readily onto the discharge wire. A long-life charging device can thus be provided enabling good charging of an image carrier and contributing to good image formation.

(4) When the surface of the plating film is finished to a mirror surface, adhesion of waste to the discharge wire can be curbed, whereby the plating film can be preserved in good condition over time, and the discharge wire can be maintained in a state that facilitates cleaning, as contamination adheres less readily onto the discharge wire. A long-life charging device can thus be provided enabling good charging of an image carrier and contributing to good image formation.

(5) The present invention is also an image forming apparatus having such a charging device, and hence the plating film can be preserved in good condition over time, and the discharge wire can be maintained in a state that facilitates cleaning, as contamination adheres less readily onto the discharge wire. A long-life image forming apparatus can thus be provided enabling good charging of an image carrier as well as good image formation.

(6) By using a toner having a volume average particle diameter no greater than 10 μm, and a ratio between the volume average particle diameter and a number average particle diameter from 1.00 to 1.40, the plating film can be preserved in good condition over time, and the discharge wire can be maintained in a state that facilitates cleaning, as contamination adheres less readily onto the discharge wire. A long-life image forming apparatus can thus be provided enabling good charging of an image carrier and, by setting the foregoing ratios, good image formation with high image quality at high resolution can be likewise achieved.

(7) By using a toner having an average circularity from 0.93 to 1.00, the plating film can be preserved in good condition over time, and the discharge wire can be maintained in a state that facilitates cleaning, as contamination adheres less readily onto the discharge wire. A long-life image forming apparatus can thus be provided enabling good charging of an image carrier and, by setting such an average circularity, good formation of high-definition images with reproducible appropriate density can be likewise achieved.

(8) When using a toner having a substantially spherical shape, in which a ratio r2/r1 of a major axis r1 to a minor axis r2 ranges from 0.5 to 1.0, a ratio r3/r2 of the thickness r3 to the minor axis r2 ranges from 0.7 to 1.0, and the toner satisfies the relationship major axis r1≧minor axis r2≧thickness r3, the plating film can be preserved in good condition over time, and the discharge wire can be maintained in a state that facilitates cleaning, as contamination adheres less readily onto the discharge wire. A long-life image forming apparatus can thus be provided enabling good charging of an image carrier and, by setting such shape parameters, good formation of high-quality images, with good dot reproducibility, transfer efficiency and toner fluidity can be likewise achieved.

(9) By using a toner having a shape factor SF-1 from 100 to 180 and a shape factor SF-2 from 100 to 180, the plating film can be preserved in good condition over time, and the discharge wire can be maintained in a state that facilitates cleaning, as contamination adheres less readily onto the discharge wire. A long-life image forming apparatus can thus be provided enabling good charging of an image carrier and, by setting such shape parameters, good formation of high-quality images, with good toner fluidity and transferability, and in which toner scattering on the image can be suppressed or controlled can be likewise achieved.

(10) By using a toner obtained by performing, in an aqueous medium and in the presence of resin microparticles, a crosslinking and/or extension reaction in a toner composition that contains, at least, a polyester prepolymer having a functional group containing a nitrogen atom, a polyester, a colorant and a releasing agent, the plating film can be preserved in good condition over time, and the discharge wire can be maintained in a state that facilitates cleaning, as contamination adheres less readily onto the discharge wire. A long-life image forming apparatus can thus be provided enabling good charging of an image carrier as well as good image formation, using a toner having a small particle size and a narrow particle diameter distribution.

(11) The present invention is also a process cartridge, detachably mountable on an image forming apparatus, and integrally comprising at least one among a charging device, an image carrier that is charged by the charging device, a developing device for developing a latent image formed on the surface of the image carrier, and a cleaning device for cleaning the surface of the image carrier. As a result, the plating film can be preserved in good condition over time, and the discharge wire can be maintained in a state that facilitates cleaning, as contamination adheres less readily onto the discharge wire. An image process cartridge can thus be provided that can be handled as a replacement part, boasting thus good maintenance characteristics, and that can be used in a long-life image forming apparatus that enables good charging of an image carrier as well as good image formation.

(12) The present invention provides also a charging method for charging an image carrier using the above charging device, wherein the plating film can be preserved in good condition over time, and the discharge wire can be maintained in a state that facilitates cleaning, as contamination adheres less readily onto the discharge wire, so that the image carrier can be charged well over long periods of time. The charging method can contribute thus to achieving good image formation.

(13) The present invention is also an image forming method for forming an image using such a charging device, or such an image forming apparatus, or such a charging method, wherein the plating film can be preserved in good condition over time, and the discharge wire can be maintained in a state that facilitates cleaning, as contamination adheres less readily onto the discharge wire, so that the image carrier can be charged well over long periods of time. The image forming method can contribute thus to achieving good image formation Various modifications will become possible for those skilled in the art after receiving the teachings of the present disclosure without departing from the scope thereof.

What is claimed is:

1. A charging device, comprising:

a discharge wire that charges an image carrier; and a cleaning member that cleans the discharge wire, wherein the cleaning member includes an abrasive containing alumina or silicon, a grain size of the abrasive ranges from #6000 to #8000, the discharge wire is a tungsten wire on which a plating film is formed by gold plating, and a thickness of the plating film is not smaller than 1.5 μm, and a diameter of the tungsten wire is not smaller than 30 μm.

2. The charging device according to claim 1, wherein the thickness of the plating film is not greater than 3 μm.

3. The charging device according to claim 1, wherein the diameter of the tungsten wire ranges from 40 μm to 60 μm.

4. The charging device according to claim 1, wherein a surface of the plating film is finished to a mirror surface.

5. The charging device according to claim 1, wherein the abrasive contains alumina and silicon.

6. An image forming apparatus having a charging device, the charging device comprising:

a discharge wire that charges an image carrier; and a cleaning member that cleans the discharge wire, wherein the cleaning member includes an abrasive containing alumina or silicon, a grain size of the abrasive ranges from #6000 to #8000, the discharge wire is a tungsten wire on which a plating film is formed by gold plating, a thickness of the plating film is not smaller than 1.5 μm, and a diameter of the tungsten wire is not smaller than 30 μm.

7. The image forming apparatus according to claim 6, wherein the thickness of the plating film is not greater than 3 μm.

8. The image forming apparatus according to claim 6, wherein the diameter of the tungsten wire ranges from 40 μm to 60 μm.

9. The image forming apparatus according to claim 6, wherein a surface of the plating film is finished to a mirror surface.

10. The image forming apparatus according to claim 6, further comprising a toner having a volume average particle diameter not greater than 10 μm, and a ratio between the volume average particle diameter and a number average particle diameter from 1.00 to 1.40.

11. The image forming apparatus according to claim 6, further comprising a toner having an average circularity from 0.93 to 1.00.

12. The image forming apparatus according to claim 6, further comprising a toner, which has a substantially spherical shape, and in which a ratio r2/r1 of a major axis (r1) to a minor axis (r2) ranges from 0.5 to 1.0, a ratio r3/r2 of the thickness (r3) to the minor axis (r2) ranges from 0.7 to 1.0, and relationship, where major axis r1≦minor axis r2≦thickness r3 is satisfied.

13. The image forming apparatus according to claim 6, further comprising a toner having a shape factor SF-1 from 100 to 180 and a shape factor SF-2 from 100 to 180.

14. The image forming apparatus according to claim 6, wherein a toner is obtained by performing, in an aqueous medium and in the presence of resin microparticles, a crosslinking and/or extension reaction in a toner composition that contains, at least, a polyester prepolymer having a functional group containing a nitrogen atom, a polyester, a colorant and a releasing agent.

15. The image forming appartus according to claim 6, wherein the abrasive contains alumina and silicon.

16. A process cartridge, which is detachably mounted on an image forming apparatus, and which integrally comprises at least one of a charging device, an image carrier that is charged by the charging device, a developing device for developing a latent image to be formed on a surface of the image carrier, and a cleaning device for cleaning the surface of the image carrier, the charging device comprising:

a discharge wire that charges an image carrier, and a cleaning member that cleans the discharge wire, wherein the cleaning member includes an abrasive containing alumina or silicon, a grain size of the abrasive ranges from #6000 to #8000, the discharge wire is a tungsten wire on which a plating film is formed by gold plating, a thickness of the plating film is not smaller than 1.5 μm, and a diameter of the tungsten wire is not smaller than 30 μm.

17. The process cartridge according to claim 16, wherein the thickness of the plating film is not greater than 3 μm.

18. The process cartridge according to claim 16, wherein the diameter of the tungsten wire ranges from 40 μm to 60 μm.

19. The process cartridge according to claim 16, wherein a surface of the plating film is finished to a mirror surface.

20. The process cartridge according to claim 16, wherein the abrasive contains alumina and silicon.

* * * * *